US005669334A

United States Patent [19]

Schönfeld et al.

[11] Patent Number: 5,669,334

[45] Date of Patent: Sep. 23, 1997

[54] INJECTION VALVES FOR LIQUID-FUEL MIXTURES AND ASSOCIATED PROCESSES

[75] Inventors: Dieter Schönfeld, Markdorf; Bernhard Bächle; Martin Freitag, both of Friedrichshafen; Torsten Guth, Gerswalde, all of Germany

[73] Assignee: MTU Motoren-und Turbinen-Union Friedrichshafen GmbH, Friedrichshafen, Germany

[21] Appl. No.: 535,022

[22] PCT Filed: Feb. 10, 1995

[86] PCT No.: PCT/EP95/00497

§ 371 Date: Dec. 27, 1995

§ 102(e) Date: Dec. 27, 1995

[87] PCT Pub. No.: WO95/21998

PCT Pub. Date: Aug. 17, 1995

[30] Foreign Application Priority Data

Feb. 11, 1994 [DE] Germany ..... 44 04 325.2
Jul. 18, 1994 [DE] Germany ..... 44 25 339.7

[51] Int. Cl.[6] ..... F02M 43/04; F02M 47/02

[52] U.S. Cl. ..... 123/25 R; 123/256

[58] Field of Search ..... 123/456, 467, 123/447, 25 C, 25 R, 25 E, 25 J, 575; 239/88–96

[56] References Cited

U.S. PATENT DOCUMENTS

| | | | |
|---|---|---|---|
| 4,732,114 | 3/1988 | Binder et al. | 123/25 E |
| 4,782,794 | 11/1988 | Hsu | 123/23 |
| 5,170,751 | 12/1992 | Tosa et al. | 123/25 C |
| 5,174,247 | 12/1992 | Tosa | 123/25 |
| 5,176,120 | 1/1993 | Takahashi | 123/467 |
| 5,235,954 | 8/1993 | Sverdlin | 123/467 |
| 5,438,968 | 8/1995 | Johnson et al. | 123/467 |
| 5,441,028 | 8/1995 | Felhofer | 123/456 |
| 5,441,029 | 8/1995 | Hlousek | 123/467 |
| 5,529,024 | 6/1996 | Wirbeleit et al. | 123/25 C |

FOREIGN PATENT DOCUMENTS

| | | |
|---|---|---|
| 0064146 | 6/1985 | European Pat. Off. . |
| 2758057 | 6/1979 | Germany . |
| 3931456 | 4/1991 | Germany . |

OTHER PUBLICATIONS

Ganser, M. Ing "The Electronically Controlled . . . " Ganser–Hydromag pp. 1–24. No Date.

*Primary Examiner*—Thomas N. Moulis
*Attorney, Agent, or Firm*—Ladas & Parry

[57] ABSTRACT

Injection system for the intermittent introduction of a fuel-liquid mixture into the combustion spaces of an internal-combustion engine with a common-rail pressure reservoir. Lines (16, 30) lead to control spaces (15, 22) of control valves (1). Control space (15) is joined selectively with the common-rail pressure reservoir or a line (18) with a pressure p0 or a line with a pressure p1 for control of injection quantities of the fuel-liquid mixture. Control space (22) is joined selectively to the common-rail pressure reservoir or to a line with pressure p2 or to a line (33) with pressure p0 for control of the liquid fraction of the injection quantity.

30 Claims, 16 Drawing Sheets

INJECTION VALVES FOR LIQUID-FUEL MIXTURES AND ASSOCIATED PROCESSES

FIELD OF THE INVENTION

The invention concerns injection systems for intermittent introduction of fuel-liquid mixtures into combustion spaces of an internal-combustion engine and a process for the operation of injection systems of the invention,

BACKGROUND AND PRIOR ART

In order to reduce pollutant emissions in the exhaust and to reduce the fuel consumption of diesel engines, liquid can be injected with the fuel into the combustion spaces of the diesel engine. However, the service life of the injection pump is greatly reduced due to corrosion and cavitation, if liquid and fuel are mixed prior to the injection pump.

It is known from U.S. Pat. No. 5,174,247 how to inject fuel and water together by means of an injection valve into a cylinder of a diesel engine. Fuel and liquid inlet lines to an injection valve are alternately opened and closed, so that a layered fuel-water mixture is formed in the injection valve.

It is known from EP-C 0 064,146 how to inject two fuels through one injection valve into a cylinder of an internal-combustion engine. Both fuels are introduced into the injection valve separately and meet each other first in the region of a tip of a valve member. A piston is provided inside the injection valve, and this piston is connected with the tip of the valve member, and a pressure reduction is effected between injections, by creating additional volume in front of the injection opening.

Conventional fuel injection systems, as they are disclosed in the two above-noted documents, produce the necessary high pressure for introducing the fuel into the combustion spaces of internal combustion engines, such as, e.g., diesel engines, with pumps that are directly driven by the internal combustion engine. At low engine speed, the pump capacity may be insufficient, and the fuel injection may be imprecise, which leads to losses in performance and elevated pollutant emissions from the internal-combustion engine.

So-called common-rail systems are known in which a central pump supplies the fuel into a high-pressure reservoir, so-called common-rail pressure reservoir, and from there continuously, and free of pulsations via lines to the injection valve. These systems isolate the injection from the pressure fluctuations that occur in conventional pumps driven directly by the engine when there are large differences in engine speed.

A common-rail injection system is known (see The electronically controlled dynamic rail injection system (DIS), Ganser-Hydromag), in which fuel coming from a fuel tank is supplied by means of a high-pressure pump into a large-volume pipe system, which is joined with the injection valve. The injection valves are actuated by hydraulic pressure, and electromagnetic valves control the opening and closing of the injection valves as a function of the operating parameters of the internal-combustion engine. A disadvantage of this injection system is that the high pressure produced by the pump is applied over long lengths of lines up to the injection openings of the injection valves, even though no injection is produced, and thus leaking of the fuel, for example, may occur both at the connection joints of the lines as well as at the closed injection openings in front in the combustion spaces. Further, this state of the art gives no indication of how a liquid, such as, e.g., water or methanol, can be introduced additionally into the fuel in front of the injection openings. Lubrication is problematical, as is also the selection of materials, and the corrosion and cavitation of pumps that are suitable for producing a constant fluid pressure at or above the fuel pressure.

SUMMARY OF THE INVENTION

An object of the invention is to create an injection system for the intermittent introduction of fuel-liquid mixtures into the combustion spaces of an internal-combustion engine and a process for operation of this injection system for intermittent introduction of fuel-liquid mixtures, which reduces wear of the pumps, keeps pressure fluctuations of the pumps away from the injection valves, and avoids leakage.

The achievement of this object is produced by means of an injection system and process for the intermittent introduction of fuel-liquid mixtures into the combustion spaces of an internal-combustion engine utilizing a common rail pressure reservoir and low pressure lines for controlling injection of fuel-liquid mixtures as well as supply of fuel and liquid to the valve of the injection system.

According to the invention, an injection system contains hydraulically actuated injection valves, which are pressurized by means of a common-rail pressure reservoir, and wherein a valve member and a piston form a control space in each injection valve and the valve member forms another control space with the housing of the injection valve. Both control spaces are connected by means of valves that can be switched selectively to the common-rail pressure reservoir or to a low-pressure line. Liquid, preferably water or methanol, is introduced into the injection valve by means of a line in front of the injection opening and fuel is introduced into the injection valve by means of another line at common-rail pressure. According to the invention, the injected quantity is determined by the switching position of the valve for the control space, which is formed by the valve member and the housing.

The proportion of liquid per injection is determined precisely according to the invention by means of a preferably electromagnetic 3/2-way valve for the switchable connection of the control space between the piston and the valve member to the common-rail pressure reservoir or to the low-pressure line.

The separate introduction of liquid at reduced pressure in front of the injection opening of the injection valve is produced according to the invention by means of an additional valve, which is formed by the cooperation of the piston with the housing within the injection valve, and with a check valve in a fuel introduction line that can be controlled in a precise manner, whereby, with the arrangement of a check valve in the line for the separate introduction of liquid according to the invention, the fuel mixture is prevented from flowing out through separate liquid introduction line.

The piston and a borehole in the housing of the injection valve of the injection system of the invention may be provided selectively with an additional gradation and the housing can be provided with an additional overflow oil borehole.

In a second injection system according to the invention, the fuel-liquid mixture is transported in a common line in front of the injection opening. The liquid quantity per injection is dependent on the injection time.

In an advantageous configuration of the second injection system of the invention, the valve member forms with the housing the switchable valve for the control space between valve member and piston, and the movements of the valve member relative to the housing determine the pressure in the control space. The duration of application of a reduced pressure determines the introduced fuel quantity.

A spring between the valve member and housing, according to the invention, improves the dynamic behavior of the injection valve of the second injection system of the invention.

The process for operation of the above-noted injection systems according to the invention can be controlled particularly simply and reliably according to the invention by activating two valves.

According to the invention, a third injection system has hydraulically actuated injection valves, which are pressurized by a common-rail pressure reservoir, whereby a valve member and a piston form a control space in each injection valve, and the valve member forms a control space with the housing of the injection valve. The control space between the valve member and the piston is joined by means of a switchable valve selectively to the common-rail pressure reservoir or to a line at a fuel pressure p0. The control space between the valve member and the housing is joined selectively by means of a switchable valve to the common-rail pressure reservoir or to a line at a fuel pressure p2. Liquid at a pressure p1 is introduced into the injection valve by means of a separate line in front of the injection opening. The switching positions of the valve for the control space between valve member and housing determine the injection quantities, and the switching positions of the valve for the control space between valve member and piston determine the liquid quantity to be injected.

According to the invention, fuel is introduced selectively with common-rail pressure or fuel pressure p2 into the injection valve of the third injection system by means of a valve.

The separate introduction of liquid at reduced pressure p1 in front of the injection opening of the injection valve of the third injection system of the invention is produced by means of an additional valve, which is formed by the cooperation of the outer tapered end of the valve member with the housing of the injection valve within the injection valve, and can be metered precisely to a check valve in the fuel introduction line, whereby, with the arrangement of a check valve in the line for the liquid introduction, the fuel mixture is prevented from flowing out through the line for the separate liquid introduction.

A choke between the 3/2-way valve and the control space between valve member and piston suppresses movements of the piston relative to the valve member according to the invention.

According to an advantageous further development of the third injection system, the invention has a 4/2-way valve, which is arranged such that either the fuel introduction line is connected with the line with the fuel pressure p2 and the control space between valve member and housing is connected with the common-rail pressure reservoir, or the fuel introduction line is connected with the common-rail pressure reservoir and the control space between the valve member and the housing is joined with the line with the fuel pressure p2. A process for the operation of the third injection system of the invention can be controlled particularly simply and reliably by actuating two valves.

A fourth injection system of the invention contains hydraulically actuated injection valves in which a valve member forms a control space with the housing in each injection valve. The control space between valve member and housing is joined selectively by means of a switchable valve to the common-rail pressure reservoir or to a line at a fuel pressure p0. A piston in a positive-displacement housing forms with the latter an upper and a lower control space. The lower control space and preferably also the upper control space may be pressurized alternatively by means of a switchable valve at the pressure p0 or a pressure p2. If the lower control space is loaded with pressure p2, the piston moves from a lower to an upper position in the positive-displacement housing, so that by means of a connection with the fuel introduction line, the pressure is reduced in front of the injection opening in the injection valve, and liquid can flow into the injection valve via a separate line in front of the injection opening. The switching positions of the valve for the control space between valve member and housing determine the injection quantity, and that of the valve for the control spaces between positive-displacement housing and piston determine the quantity of liquid to be injected.

According to an advantageous embodiment of this fourth injection system, only the lower control space between piston and positive-displacement housing is loaded with pressure p2 or pressure p0 and a spring presses the piston continuously into a lower position in the positive-displacement housing, so that the pressure in the upper control space can be equal to the ambient pressure.

According to another advantageous embodiment of the fourth injection system, the pressure in the control space between valve member and housing and in the fuel introduction line is controlled by a 4/2-way valve. A bypass line is provided for the connection line from the valve to the fuel introduction line and check valves are contained in the bypass line and in the connection line from the valve to the fuel introduction line.

A combination of the two previously noted embodiments of this fourth injection system produces another preferred variant of the invention. A process for operation of the fourth injection system of the invention can be controlled particularly simply and reliably by means of two valves.

DETAILED DESCRIPTION OF PREFERRED EMBODIMENTS

Figure 1:
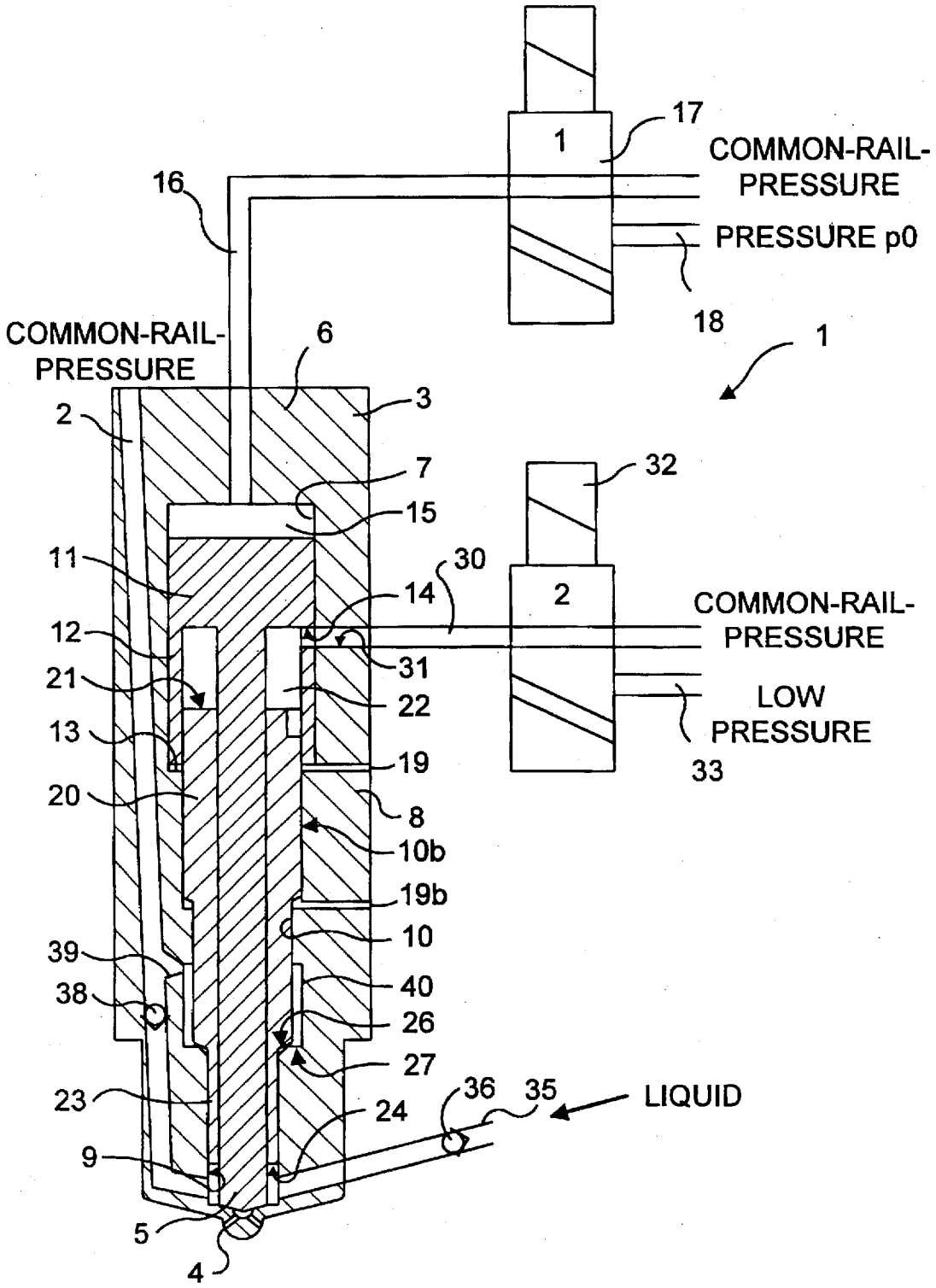
FIG. 1 is a cross section through an injection system in a phase 1.
Figure 2:
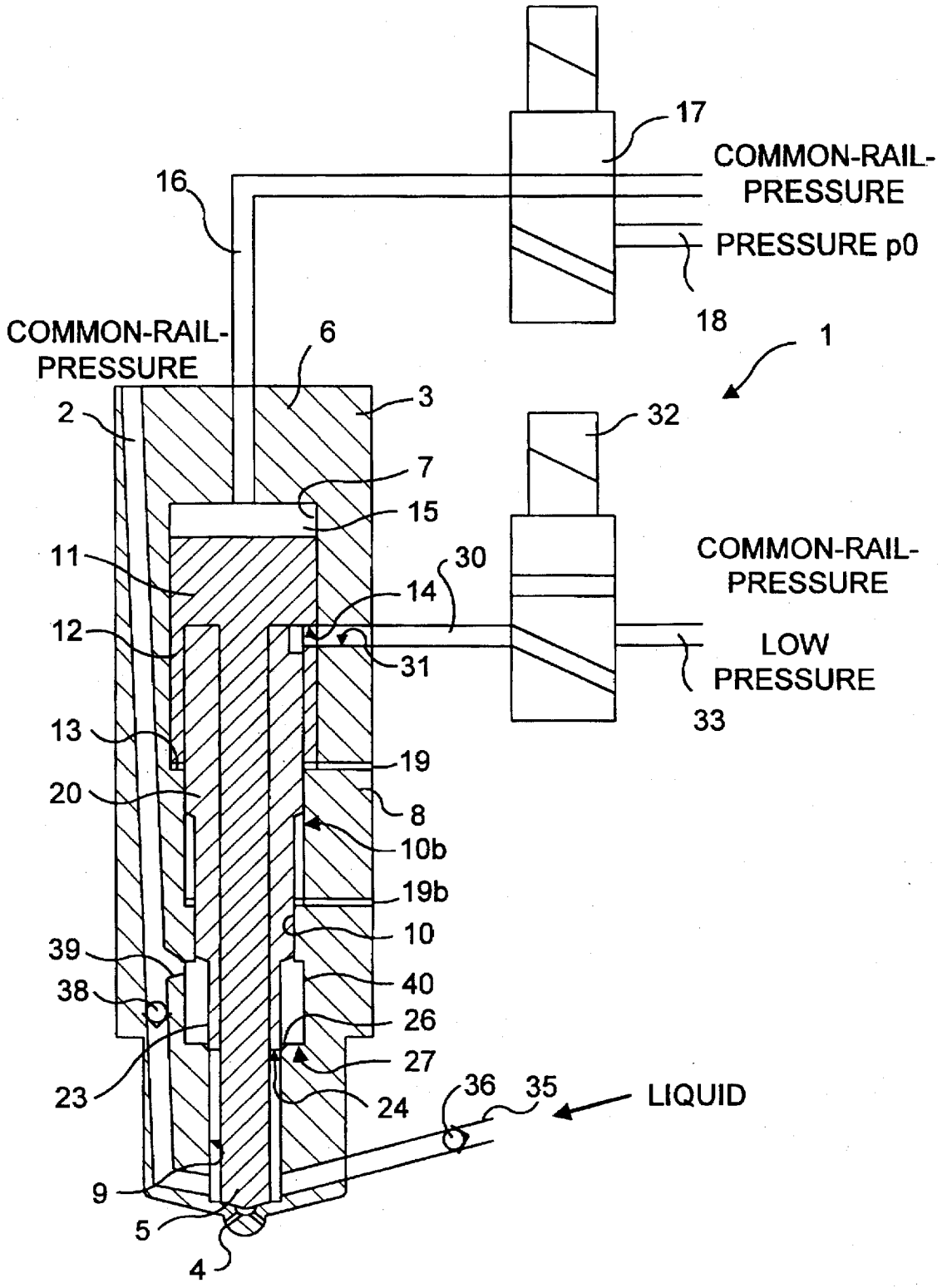
FIG. 2 is a cross section through an injection system in a phase 3.
Figure 3:
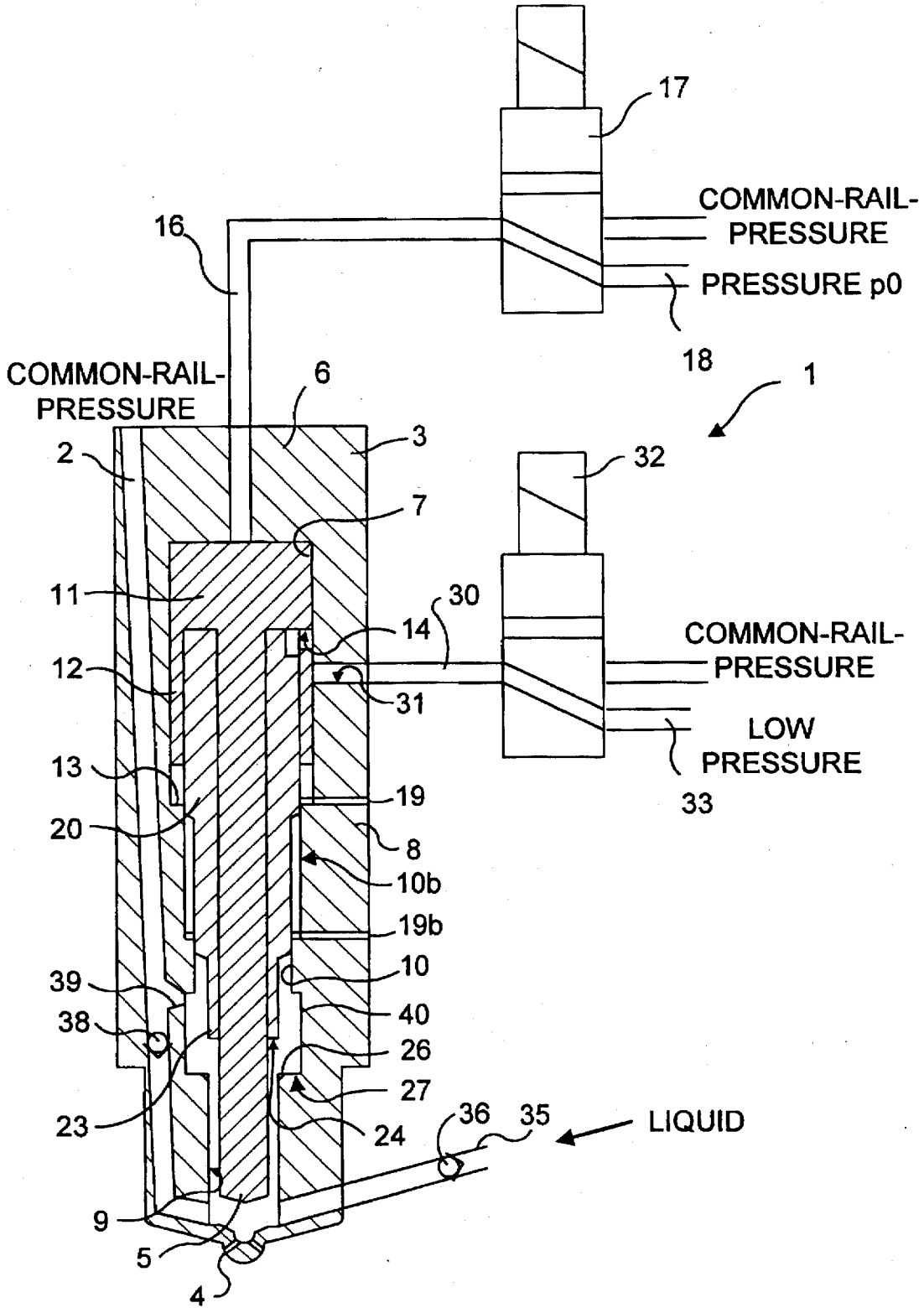
FIG. 3 is a cross section through an injection system in a phase 4.

Each of FIGS. 1–3 represents a cross section through an injection valve 1 of the invention of a common-rail system (not shown) whose injection process is produced in five phases. Injection valve 1 is one of several injection valves (not shown) of the injection system according to the invention for a multi-cylinder internal combustion engine (not shown), especially a diesel engine.

A line 2 leads to injection valve 1 from a common-rail pressure reservoir (not shown) of the injection system of the invention, in which, e.g., fuel is stored at a high pressure pcr, wherein pcr=1200–1500 bars.

Injection valve 1 has a housing 3 with at least one injection opening 4 and a rotation-symmetric valve member 5. In the direction of a longitudinal axis of housing 3, valve member 5 is supported so that it can displace in housing 3 for opening and closing injection opening 4.

Housing 3 is preferably made of two parts 6, 8. In part 6 remote from injection opening 4, housing 3 has a central borehole 7 with a diameter a.

Part 8 of housing 3, which also contains injection opening 4, has a central borehole 9 with diameter b in a lower section adjacent to injection opening 4, and in a central section closer to part 6, it has a central borehole 10 with diameter c. A central borehole 10*b* with a diameter d is located between central borehole 10 and central borehole 7. Diameter d is smaller than diameter a and larger than diameter c. Diameter a is larger than diameter b, and diameter b is smaller than diameter c. An oil overflow borehole 19 is contained at the juncture between part 6 and part 8 of housing 3. An oil overflow borehole 19*b* is contained at the transition from diameter d to diameter c in housing 3.

Valve member 5 has a piston-shaped end piece 11 at its end remote from injection opening 4, and valve member 5 extends from end piece 11 into borehole 7 of part 6 of housing 3. Piston-shaped end piece 11 presents an open E shape to injection opening 4 in cross section, and the outer leg 12 of piece 11 can be applied to a planar shoulder 13 of part 8. A radially directed borehole 14 is formed in the outer leg 12 of piston-shaped end piece 11.

Piston-shaped end piece 11 of valve member 5 in borehole 7 of part 6 forms with housing 3 a control space 15, into which opens a line 16, which joins control space 15 by means of an electromagnetic 3/2-way valve 17 with the common-rail pressure reservoir or with a low-pressure line 18.

Injection valve 1 contains a hollow piston 20, which is arranged coaxially to valve member 5. The piston-shaped end piece 11 and outer leg 12 of valve member 5 enclose a control space 22 with a front surface 21 of piston 20. Piston 20 has a constant inner diameter and is guided in a displaceable and liquid-tight manner on valve member 5.

The outer diameter of piston 20 is stepped, whereby piston 20 has a cylindrical front surface 24 on a part 23 of smaller diameter turned toward injection opening 4 and a cylindrical front surface 21 of larger diameter facing the piston-shaped end piece 11. Piston 20 is guided tightly in central boreholes 9, 10, 10*b* in housing 3, so that no liquid can pass between piston 20 and housing 3. Piston 20 has on its outer periphery a stop 26, which cooperates with a valve seat 27 in part 8 of housing 3.

A line 30 opens into a radially directed borehole 31 of part 6 of housing 3. Line 30 contains an electromagnetic 3/2-way valve 32, which joins line 30 either with the common-rail pressure reservoir or a low-pressure line 33.

Next to injection opening 4 a line 35 opens, into which liquid is transported into injection valve 1 from a tank (not shown). Line 35 contains a check valve 36, which prevents the outflow of fuel mixture through line 35 from the region in front of injection opening 4.

A check valve 38 is contained in line 2, and prevents the introduction of fuel through line 2 to injection opening 4, but makes possible the outflow in the direction of line 2 from the region directly in front of injection opening 4. A borehole 39 in part 8 of housing 3 branches off from line 2 in front of check valve 38, and opens into an annular chamber 40 inside central borehole 10. Part 23 of piston 20 acts as a valve with housing 3 and controls the inflow of fuel from line 2 in front of injection opening 4.

Figure 4:
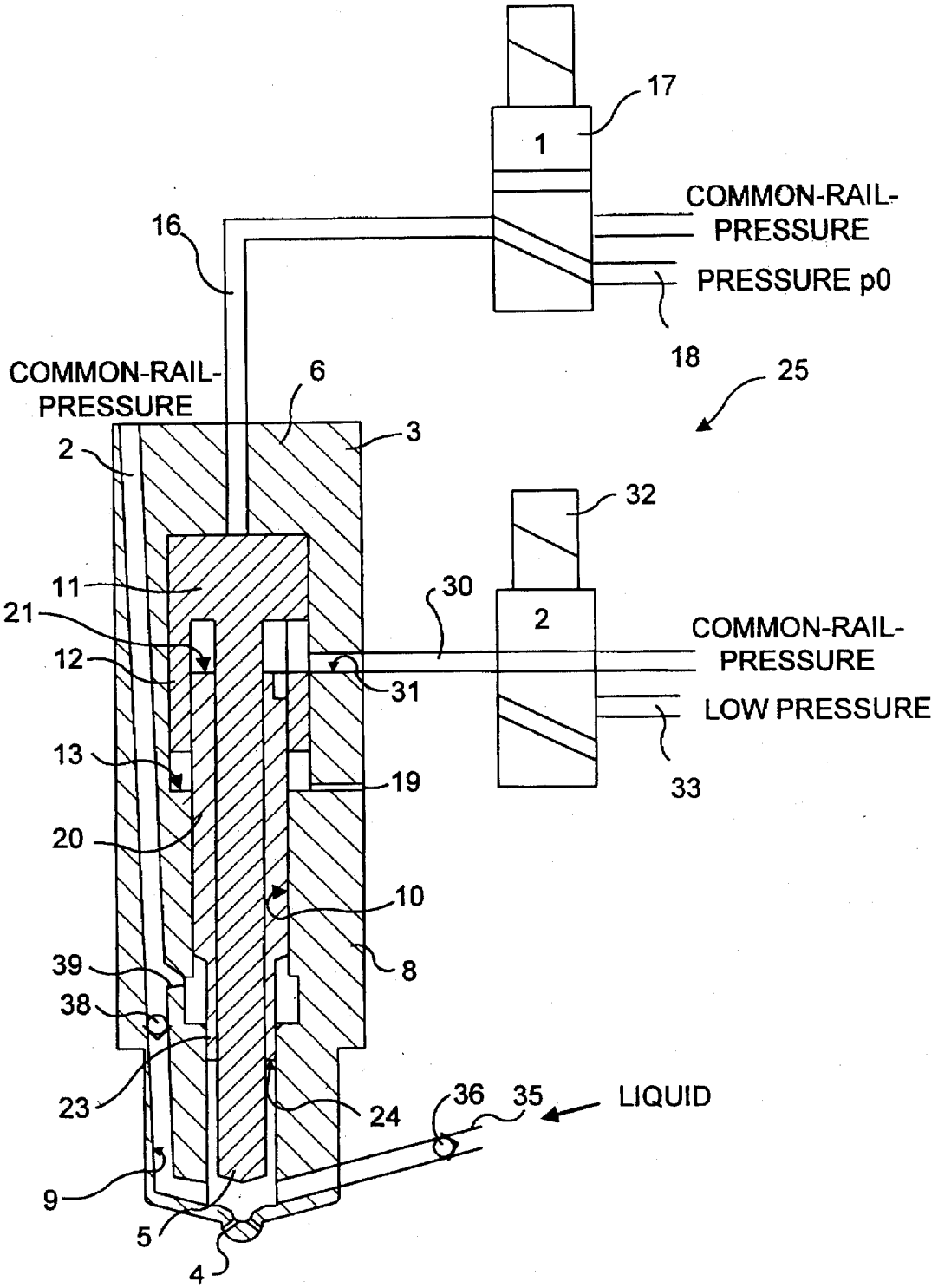
FIG. 4 is a cross section through a modified injection system in a phase 5.

FIG. 4 represents a cross section through a modified injection valve 25 according to the invention. Structural elements of injection valve 25 according to FIG. 4, which correspond to the elements of injection valve 1 according to FIGS. 1–3, have the same references.

Part 8 of housing 3, which also contains injection opening 4, has central borehole 9 with diameter b in the lower section adjacent to injection opening 4, and central borehole 10 with diameter c in a central section closer to part 6. Diameter a is greater than diameter b, and diameter b is smaller than diameter c. Overflow oil borehole 19 is contained at the juncture between part 6 and part 8 of housing 3.

Injection valve 25 contains hollow piston 20, which is arranged coaxially to valve member 5. The piston-shaped end piece 11 and the outer leg 12 of valve member 5 enclose control space 22 with front surface 21 of piston 20. Piston 20 has a constant inner diameter and is guided on valve member 5 in a displaceable and liquid-tight manner.

The outer diameter of piston 20 is stepped, whereby piston 20 has cylindrical front surface 24 on part 23 of smaller diameter facing injection opening 4 and cylindrical front surface 21 of larger diameter on the end facing piston-shaped end piece 11. Piston 20 is guided tightly in central boreholes 9, 10 in housing 3, so that no liquid can pass between piston 20 and housing 3. Piston 20 has on its outer periphery stop 26, which cooperates with valve seat 27 in part 8 of housing 3.

Process for the operation of the injection system according to the invention

During the operation of the internal-combustion engine, fuel at high pressure is continuously available from the common-rail pressure reservoir in line 2 and liquid is continuously available at a preferably lower, adjustable pressure in line 35 of injection valves 1, 25.

The essential phases for the injection process of injection valve 1 are represented in FIGS. 1–3.

FIG. 1: In a phase 1, valve 17 is at a position in which control space 15 is joined with the common-rail pressure reservoir and valve member 5 is pressed by pressure on its piston-shaped end piece 11 into injection opening 4, so that no injection from injection valve 1 occurs.

Borehole 14 in piston-shaped end piece 11 and borehole 31 in part 6 of housing 3 are aligned so that control space 22 is also joined via valve 32 with the common-rail pressure reservoir, whereby stop 26 of piston 20 is pressed onto valve seat 27 in annular chamber 40, and the inflow of fuel through line 2 in front of injection opening 4 is prevented by stop 26 pressed onto the valve seat, by part 23 of piston 20, and by check valve 38.

Phase 2: Valve 17 is in a position in which control space 15 is joined to common-rail pressure reservoir, and valve member 5 is pressed into injection opening 4 of injection valve 1 by pressure on piston-shaped end piece 11 (see FIG. 2).

Valve 32 joins control space 22 with low-pressure line 33 by means of line 30 and boreholes 14, 31. Liquid from line 35 is applied in front of injection opening 4 with lower pressure than the pressure in the common-rail pressure reservoir and at a higher pressure than in low-pressure line 33, Piston 20 is lifted to cause stop 26 to move away from valve seat 27 and enlarge the volume in front of injection opening 4 in injection valve 1, so that liquid from line 35 can reach in front of injection opening 4. The switching time of valve 32 determines the quantity of liquid in injection valve 1. The fuel inflow from line 2 in front of injection opening 4 is prevented by check valve 38 and part 23 of piston 20.

FIG. 2: In a phase 3, valve 17 and valve 32 are in the position in phase 2 and piston 20 reaches the stop at piston-shaped end piece 11 of valve member 5. The introduction of liquid in front of injection opening 4 from line 35 is terminated. Valve member 5 keeps injection opening 4 closed and part 23 of piston 20 and check valve 38 prevent the introduction of fuel to injection opening 4.

FIG. 3: In a phase 4, valve 17 is in a position in which control space 15 is joined with low-pressure line 18, and valve member 5 lifts up under pressure from line 35 on front surface 24 of piston 20 and the pressure from common-rail pressure reservoir on the front surface of valve member 5 at injection opening 4. The lower part 23 of piston 20 opens a passage from annular chamber 40 to injection opening 4, so that fuel from line 2 is injected with the liquid available in front of injection opening 4 into the combustion space (not shown) of the internal-combustion engine. The switching time of valve 17 determines the injection quantity. Borehole 14 in piston-shaped end piece 11 of valve member 5 is separated from borehole 31 in part 6 of housing 3.

Phase 5: valve 17 and valve 32 are in the same positions as in phase 1 (see FIG. 1). Valve member 5 is pressed by the common-rail pressure onto its piston-shaped end piece 11 into injection opening 4, so that the injection is sealed off by injection valve 1. Borehole 14 in piston-shaped end piece 11 of valve member 5 is joined with borehole 31 in part 6 of housing 3, and pressure from the common-rail pressure reservoir acts on piston 20, which is moved into injection opening 4. Fuel from chamber 40 flows into line 2 via borehole 39 and fuel in the region in front of injection opening 4 is pressed into line 2 below check valve 38. Check valve 36 prevents the backflow of the mixture from the region in front of injection opening 4 into line 35.

The process of operation of injection valve 25 of FIG. 4 corresponds in the first four phases with the process described in FIGS. 1–3 for injection valve 1.

In the case of injection valve 25, in a phase 5 (see FIG. 4), however, valve 32 first switches to the line for the common-rail pressure reservoir. Valve member 5 is still raised from injection opening 4, so that injection through injection valve 25 continues. Borehole 14 in piston-shaped end piece 11 of valve member 5 is joined with borehole 31 in part 6 of housing 3, and pressure from the common-rail pressure reservoir operates on piston 20, which moves towards injection opening 4.

Fuel from chamber 40 is injected via borehole 39 and fuel from the region in front of injection opening 4 is injected through injection opening 4 into the combustion space.

In a phase 6 of injection valve 25, valve 17 and valve 32 are in the same positions as in phase 1 (see FIG. 1). Valve member 5 is pressed into injection opening 4 by the common-rail pressure applied to its piston-shaped end piece 11, so that the injection through injection valve 25 is terminated. Borehole 14 in piston-shaped end piece 11 of valve member 5 is joined with borehole 31 in part 6 of housing 3, and pressure from the common-rail pressure reservoir operates on piston 20, which moves towards injection opening 4. Fuel from chamber 40 is pressed via borehole 39 into line 2 and fuel from the region in front of injection opening 4 is pressed into line 2 below check valve 38. Check valve 36 prevents the backflow of the mixture from the region in front of injection opening 4 into line 35.

Figure 5:
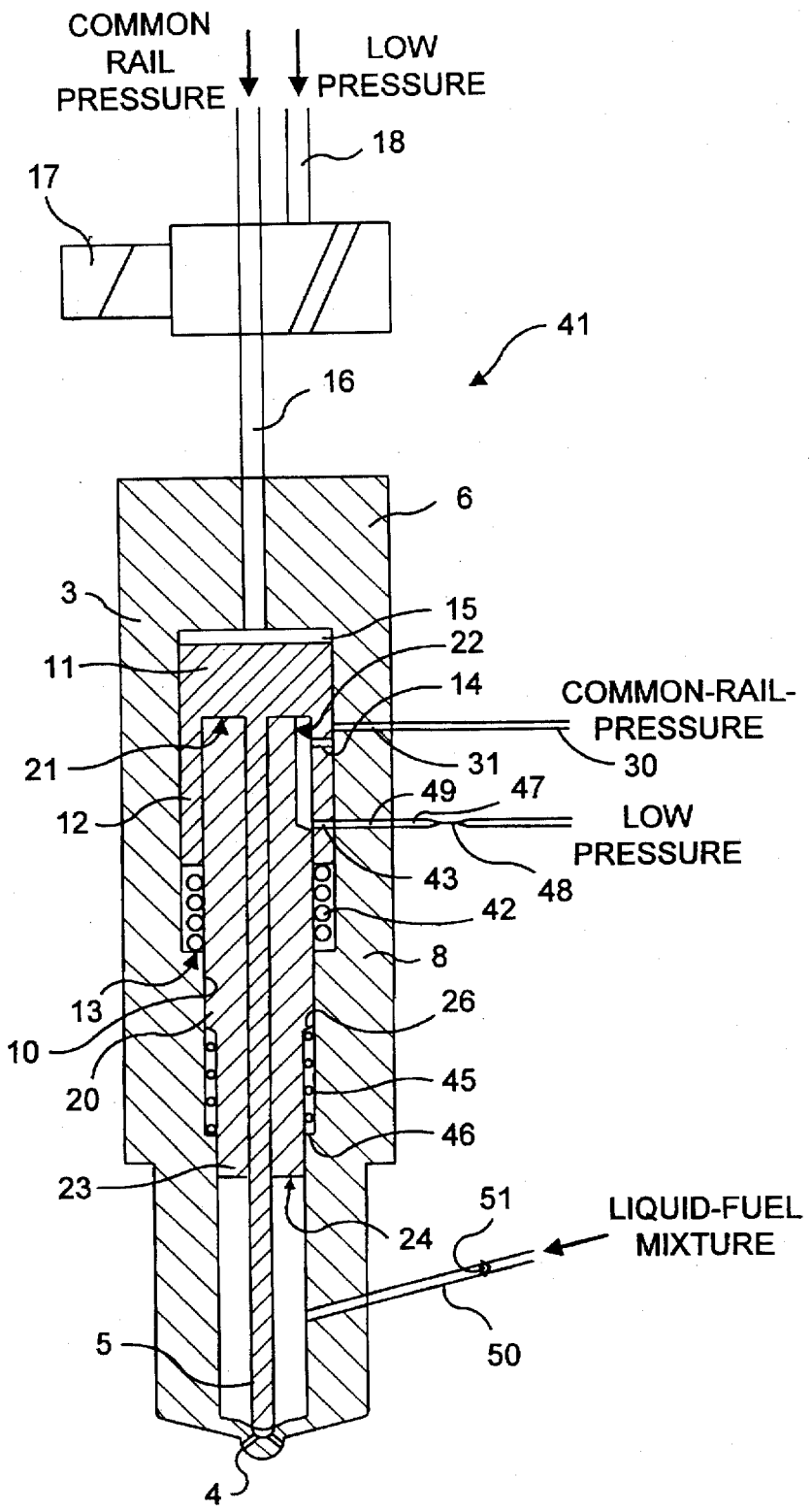
FIG. 5 is a cross section through a second injection system in phase 1.
Figure 6:
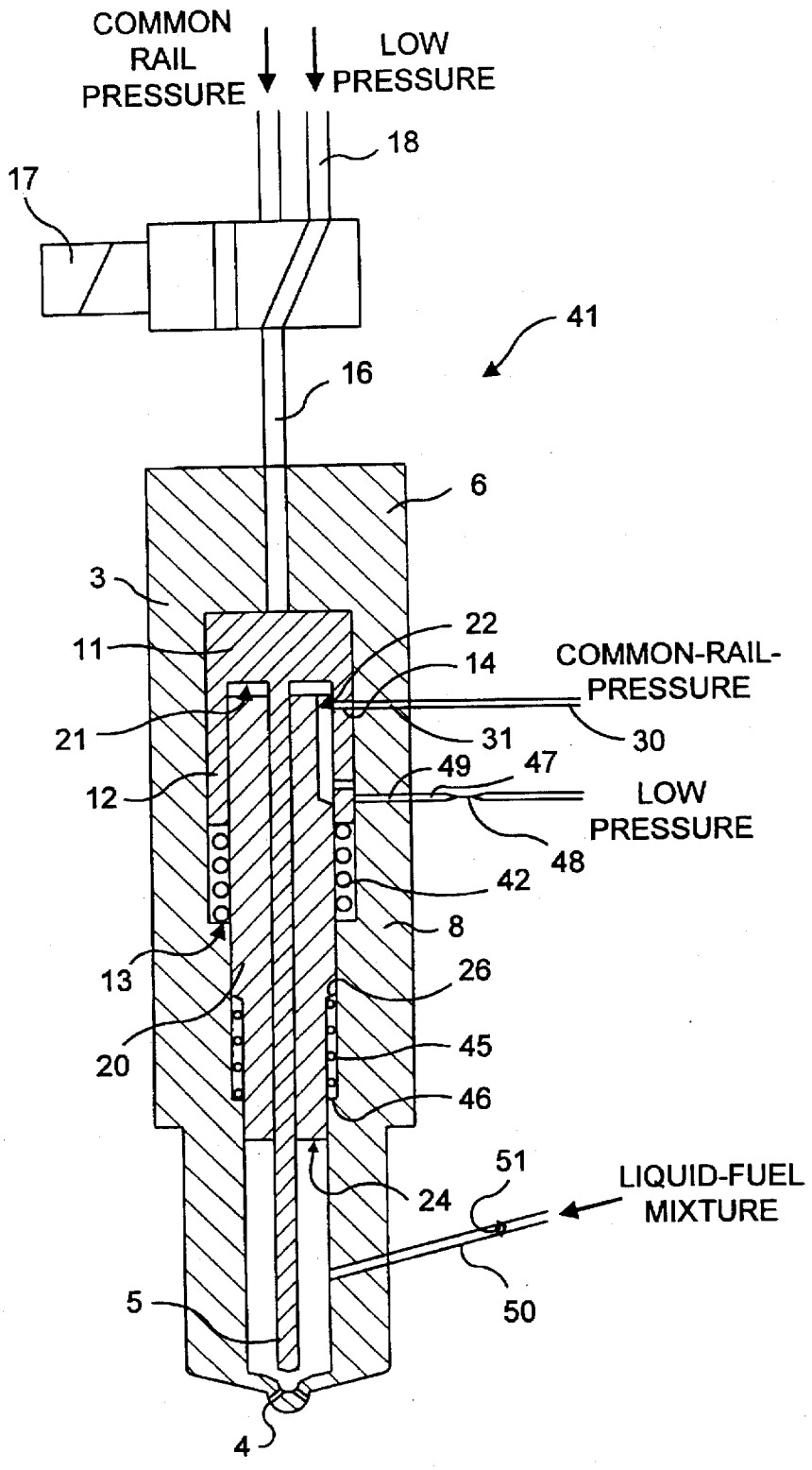
FIG. 6 is a cross section through a second injection system in phase 2.
Figure 7:
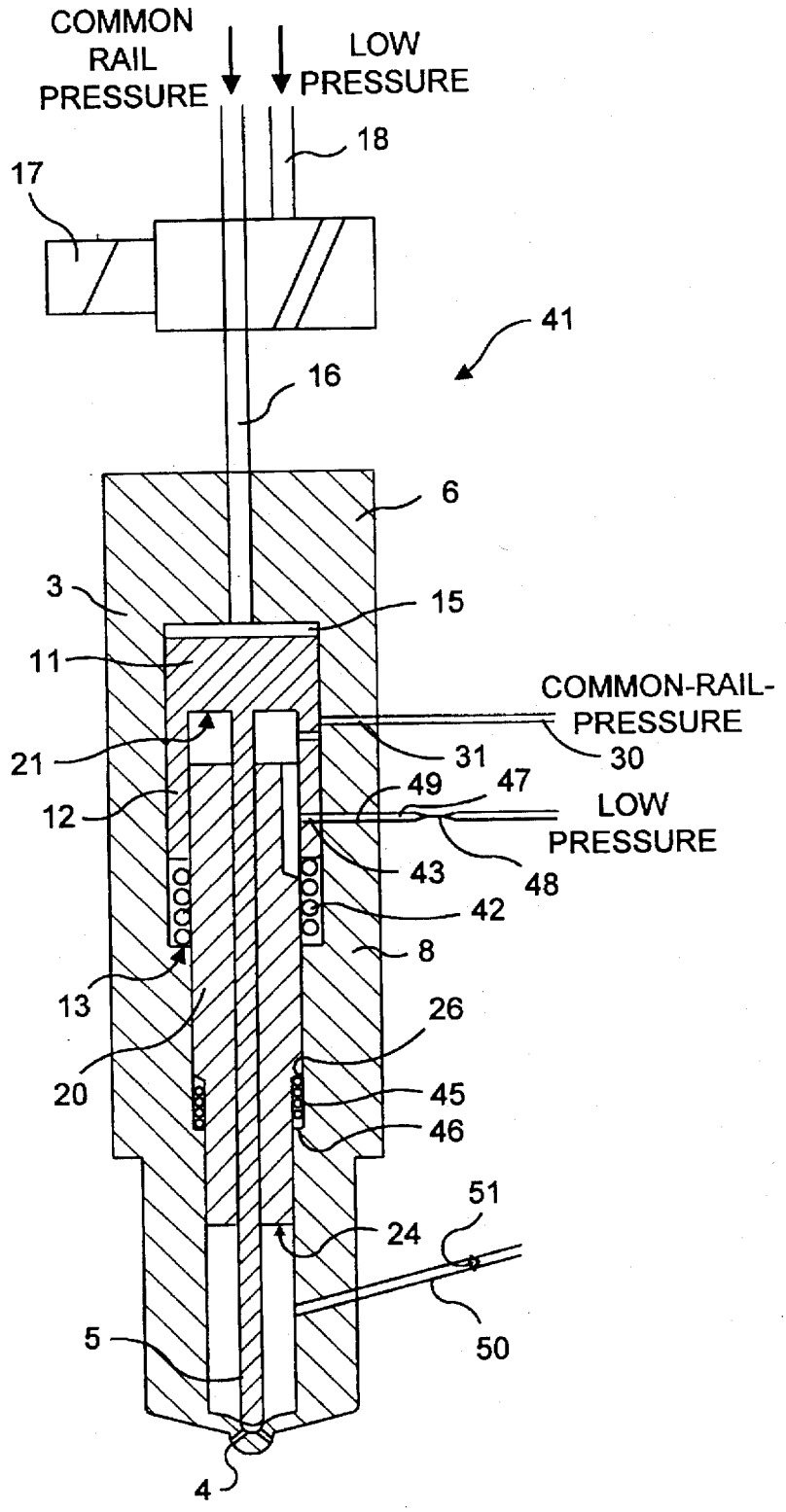
FIG. 7 is a cross section through a second injection system in phase 4.

FIGS. 5–7 represent a cross section through a second injection system containing valve 41 of a common-rail system (not shown) according to the invention during an injection process in several phases. Corresponding elements of the alternative injection valve 41 of the invention are provided with the reference numbers of the injection valve 1 described in FIGS. 1–3.

Injection valve 41 has housing 3 with at least one injection opening 4 and rotation-symmetric valve member 5. In the direction of a longitudinal axis of housing 3, valve member 5 is supported in a displaceable manner in housing 3 for opening and closing injection opening 4.

Housing 3 is preferably of two parts 6–8. In part 6 remote from injection opening 4, housing 3 has central borehole 7 with a diameter a, in part 8 of housing 3, which also contains injection opening 4, central borehole 9 with diameter b in the lower section of part 8 adjacent to injection opening 4, and central borehole 10 with diameter c in the central section of part 8. Diameter a is greater than diameters b or c and diameter b is smaller than diameter c.

Valve members has the piston-shaped end piece 11, by means of which valve member 5 is guided in borehole 7 in part 6 of housing 3. The end edge of outer leg 12 of piston 11 faces planar shoulder 13, of part 8 of housing 3. A pressure spring 42 operates in the axial direction between outer leg 12 of piston-shaped end piece 11 and planar shoulder 13 of housing 3. Radially directed borehole 14 in leg 12 is in the same angular position as radially directed borehole 43 in part 6 and is shifted in the axial direction towards injection opening 4 in FIG. 5. The piston-shaped end piece 11 of valve member 5 forms control space 15 in borehole 7 of part 6 with housing 3, into which line 16 opens, and control space 15 is joined via electromagnetic 3/2-way valve 17 with the common-rail pressure reservoir or with a low-pressure line 18.

Injection valve 41 contains piston 20 arranged coaxially on valve member 5. Piston-shaped end piece 11 of valve member 5 encloses control space 22 with front surface 21 of piston 20. Piston 20 has a constant inner diameter and is guided on valve member 5 in a displaceable and liquid-tight manner.

The outer diameter of piston 20 is stepped, whereby piston 20 has cylindrical front surface 24 on part 23 of smaller diameter facing injection opening 4 and cylindrical front surface 21 of larger diameter at the end facing piston-shaped end piece 11. Piston 20 is tightly introduced into central boreholes 9, 10 in housing 3, so that no liquid can pass between piston 20 and housing 3. Piston 20 is supported on its outer periphery by a spring 45, interposed between stop 26 on piston 20 and stop 46 in housing 3 of injection valve 41.

Line 30 opens into radially directed borehole 31 in part 6 of housing 3. Line 30 is joined with the common-rail pressure reservoir. A line 47 opens into a radially directed borehole 49 of part 6 of housing 3. Line 47 is preferably joined via a choke 48 with a low-pressure line. Boreholes 31, 49 in housing 3 of injection valve 1 are arranged with a greater axial spacing than boreholes 14, 42 in piston-shaped end piece 11 and in the same angular position as these boreholes 14, 42.

A line 50 opens into housing 3 of injection valve 41, which supplies both the fuel and liquid in front of injection opening 4. A check valve 51 is contained in line 50, and prevents the outflow of fuel mixture from the region in front of injection opening 4 into line 50.

Process for the operation of the second injection system

During operation of the internal-combustion engine, fuel and liquid are continuously available at a preferably adjustable pressure in line 50 in front of injection opening 4.

FIG. 5: In a phase 1, valve 17 is in a position, in which control space 15 is joined with the common-rail pressure reservoir. Valve member 5 is pressed by pressure onto piston-shaped end piece 11 against the force of spring 42 into injection opening 4, so that no injection occurs.

Borehole 43 in piston-shaped end piece 11 and borehole 49 in housing 3 lie above one another, so that control space 22 is joined with low-pressure line 47, and piston 20 is pressed by pressure in line 50 against piston-shaped end piece 11.

FIG. 6: In a phase 2, valve 17 is in a position, in which control space 15 is joined with low-pressure line 18, and valve member 5 is supported by pressure from line 50 on piston 20 lifted from injection opening 4 and by the force of spring 42, so that the fuel and liquid are injected.

Borehole 14 in piston-shaped end piece 11 and borehole 31 in housing 3 are aligned, so that control space 22 is joined with the common-rail pressure reservoir. Piston 20 is pressed away from piston-shaped end piece 11 of valve member 5 and moves into injection opening 4, so that the injection pressure in front of injection opening 4 is increased. Check valve 51 prevents the outflow of fuel mixture from the region in front of injection opening 4 into line 50.

Phase 3: The positions of valve member 5 and valve 17 correspond to those positions from phase 2 (see FIG. 6). Borehole 14 in piston-shaped end piece 11 and borehole 31 in housing 3 are aligned, so that control space 22 remains connected to the common-rail pressure reservoir. Piston 20 is moved by piston-shaped end piece 11 further towards injection opening 4, so that additional fuel mixture is injected and the accumulation space in front of injection opening 4 is emptied. The quantity of injection mixture is determined by the time during which valve 17 joins control space 15 with low-pressure line 18.

FIG. 7: In a phase 4, valve 17 is in a position in which control space 15 is connected to the common-rail pressure reservoir. Valve member 5 is pressed by pressure onto piston-shaped end piece 11 against the force of spring 42 into injection opening 4, so that injection no longer occurs.

Borehole 43 in piston-shaped end piece 11 and borehole 49 in housing 3 are aligned, so that control space 22 is joined with low-pressure line 47. Piston 20 is pressed by pressure from line 50 away from injection opening 4 toward piston-shaped end piece 11.

Phase 5: The positions of valve member 5 and valve 17 are identical to their positions, from phase 4 (see FIG. 7). Borehole 43 in piston-shaped end piece 11 and borehole 49 in housing 3 are aligned, so that control space 22 is joined with low-pressure line 47. Piston 20 is pressed by pressure from line 50 further toward piston-shaped end piece 11, so that the region in front of injection opening 4 fills with liquid and fuel from line 50.

Figure 8:
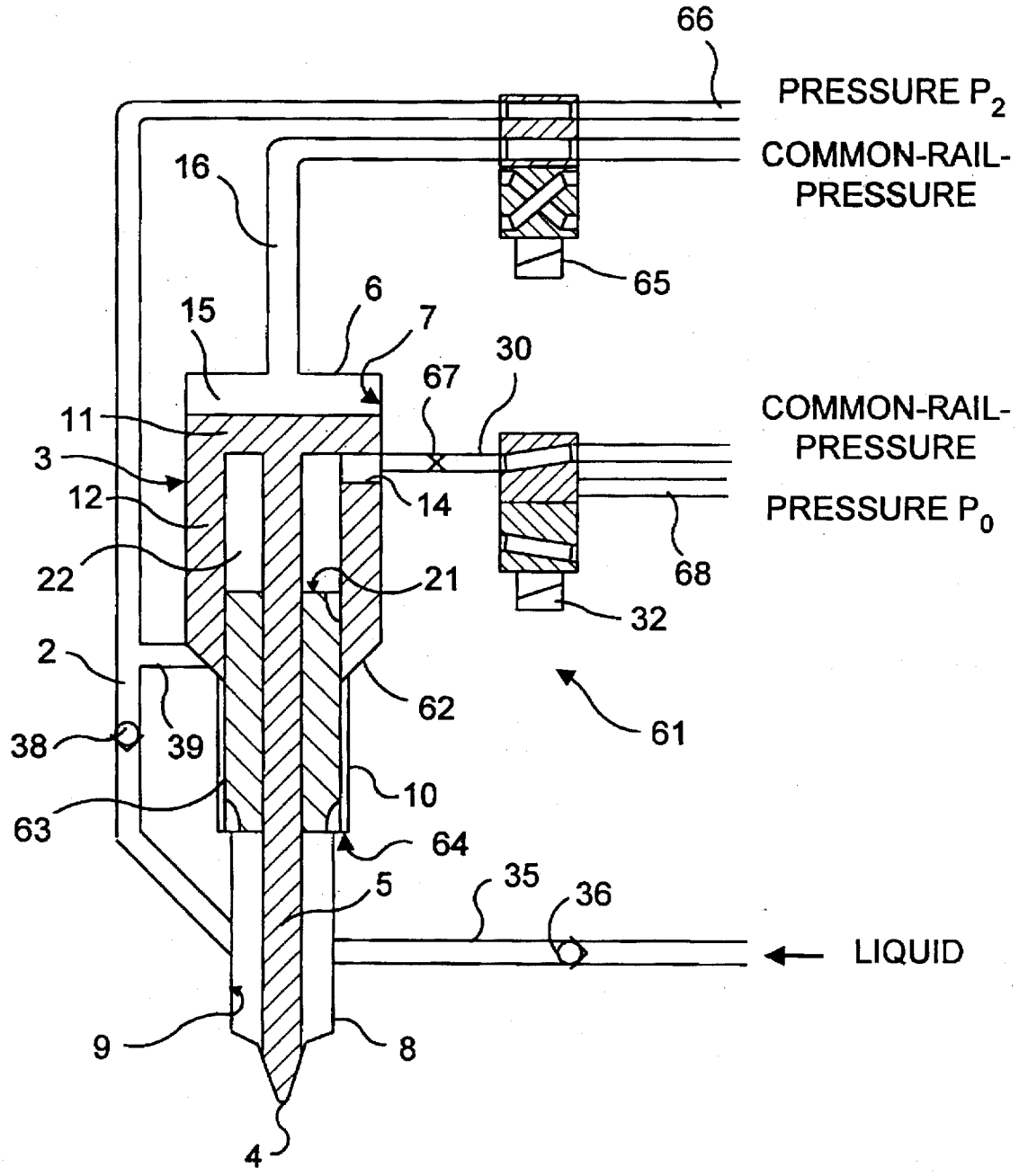
FIG. 8 is a cross section through a third injection system in phase 1.
Figure 9:
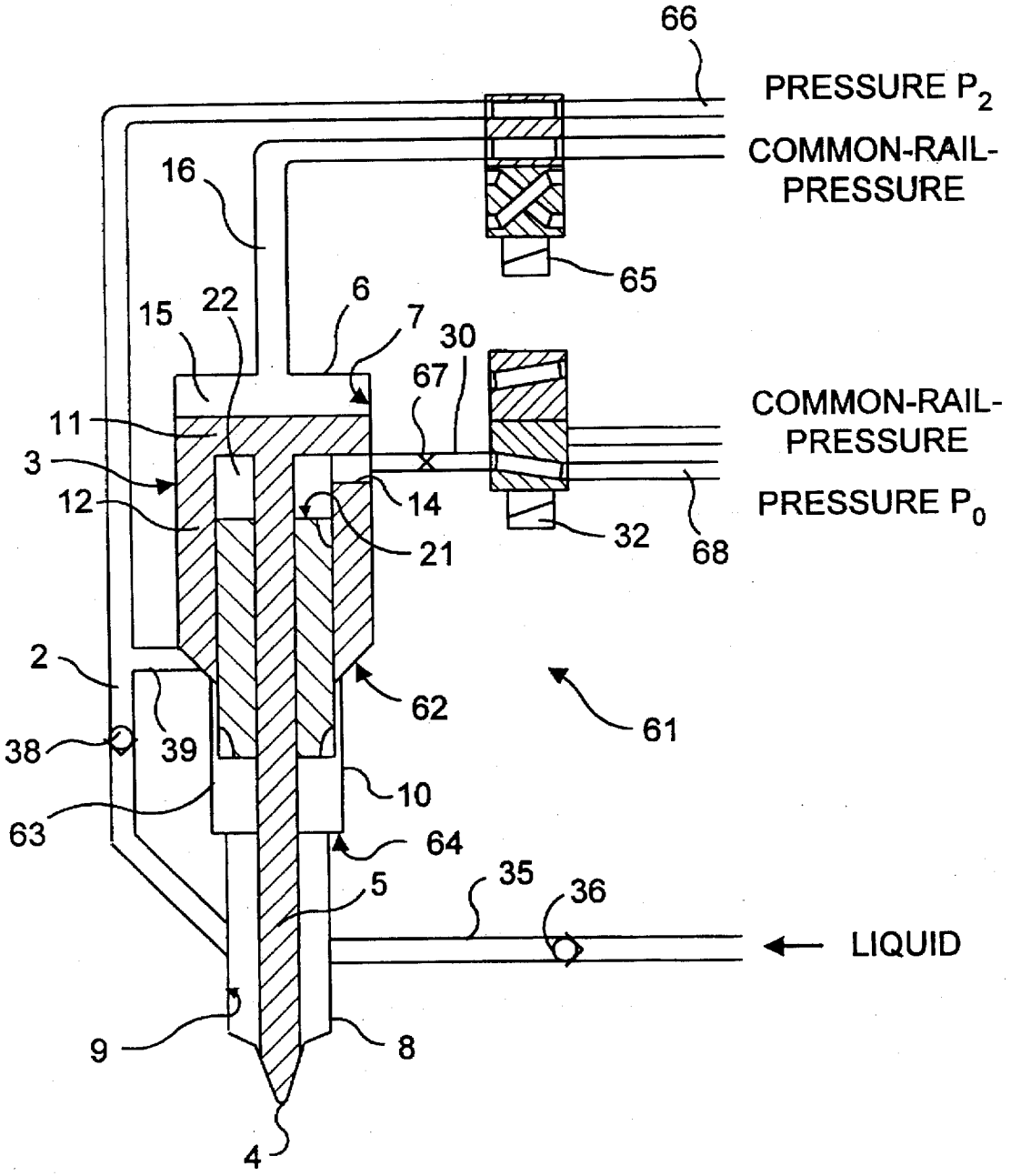
FIG. 9 is a cross section through a third injection system in phase 2.
Figure 10:
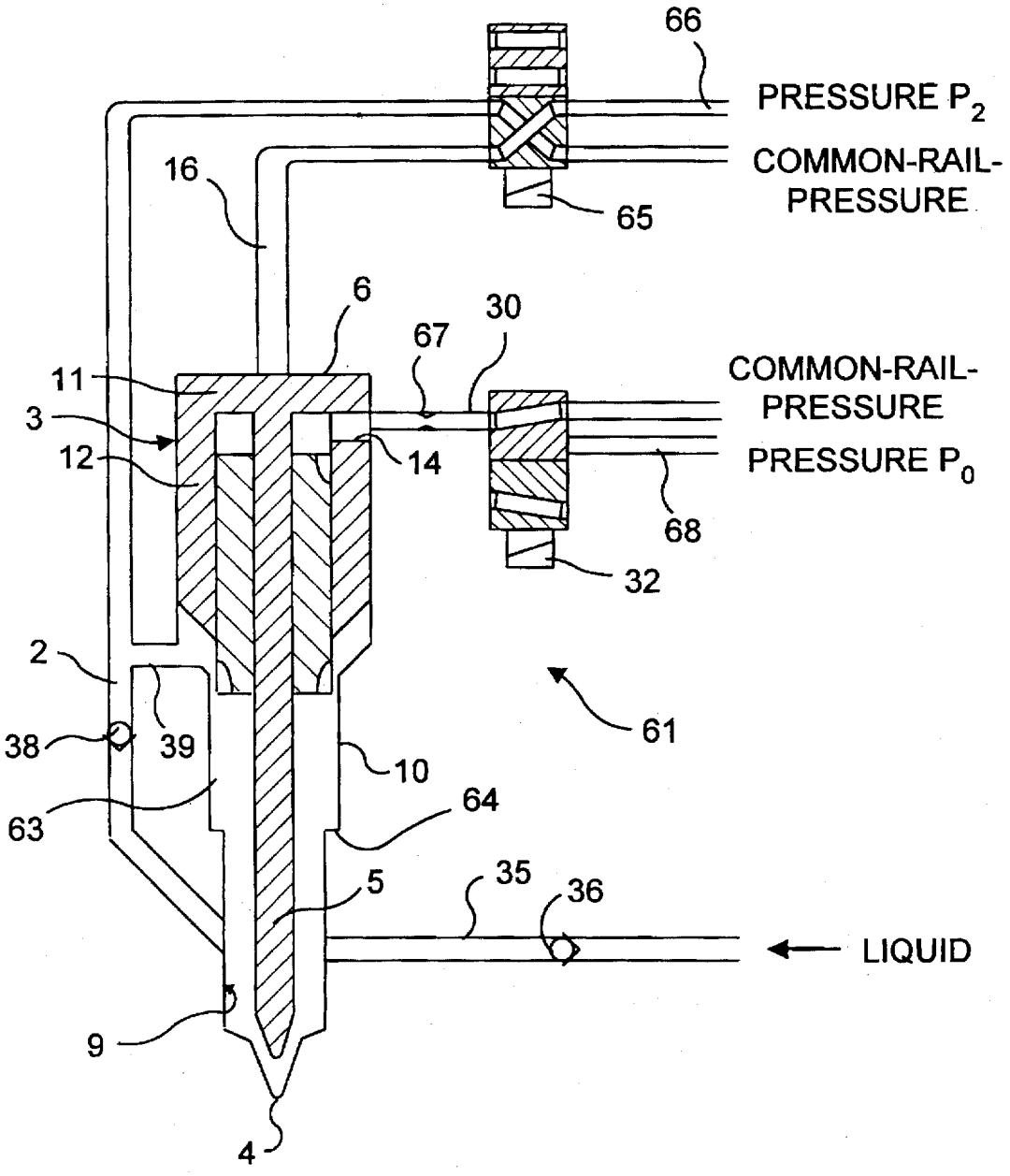
FIG. 10 is a cross section through a third injection system in phase 3.

FIGS. 8–10 each represent a cross section through a third injection system having an injection valve 61 of a common-rail system (not shown) according to the invention in four phases of an injection process. Structural features of the injection valve 61 according to FIGS. 8–10, which correspond to the features of injection system 1 according to FIGS. 1–3, have the same reference numbers.

Injection valve 61 has housing 3 with at least one injection opening 4 and rotation-symmetric valve member 5. In the direction of the longitudinal axis of housing 3, valve member 5 is supported in a displaceable manner in housing 3 for opening and closing injection opening 4.

Housing 3 has central borehole 7 with a diameter a in part 6 remote from injection opening 4. Part 8 of housing 3, which also contains injection opening 4, has central borehole 9 with diameter b in a lower section adjacent to injection opening 4, and a central borehole 10 with diameter c in a central section. Diameter a is larger than diameter b or c, and diameter b is smaller than diameter c.

Valve member 5 has at its end remote from injection opening 4 piston-shaped end piece 11, by means of which valve member 5 is guided in borehole 7 of part 6 of housing 3. The outer leg 12 of piston-shaped end piece 11 is tapered at its edge to form a valve with a valve seat 62 of housing 3. Radially directed borehole 14 is formed in the outer leg 12 of piston-shaped end piece 11.

The piston-shaped end piece 11 of valve member 5 forms control space 15 with housing 3 in borehole 7 of part 6, and line 16 opens into space 15, and joins control space 15 by means of an electromagnetic 4/2-way valve 65 with the common-rail pressure reservoir or with a line 66 at a fuel pressure p2. Line 2 leads to injection valve 61 from the 4/2-way valve 65.

Injection valve 61 contains piston 20 arranged coaxially on valve member 5. The piston-shaped end piece 11 and the outer leg 12 of valve member 5 enclose control space 22 with front surface 21 of piston 20. Piston 20 essentially has constant inner and outer diameters and is guided in a displaceable and liquid-tight manner on valve member 5. Fuel can pass through channels 63 between piston 20 and housing 3 into borehole 9 in front of injection opening 4. Piston 20 can lie against a stop 64 of housing 3.

A line 30 provided with a choke 67 opens into a radially directed borehole 31 (not shown) in part 6 of housing 3 and contains electromagnetic 3/2-way valve 32, which joins line 30 either with the common-rail pressure reservoir or with a line 68 at a fuel pressure p0.

In the vicinity of injection opening 4, line 35 opens, into which water is transported at a pressure p1 from a tank (not shown) into injection valve 61. Check valve 36 is contained in line 35, which prevents the outflow of the fuel mixture from the region in front of injection opening 4 through line 35.

Line 2 may be connected selectively by means of valve 65 with line 66 with fuel pressure p2 or the common-rail pressure reservoir. Check valve 38 is contained in line 2, which prevents the introduction of fuel through line 2 to injection opening 4, and makes possible the outflow from borehole 9 directly in front of injection opening 4 in the direction of line 2. A borehole 39 branches from line 2 to valve seat 62 in housing 3 in front of check valve 38. The inflow of fuel from line 2 in front of injection opening 4 is controlled by piston-shaped end piece 11, whose outer leg 12 forms a valve with valve seat 62 of housing 3.

The pressures p0, p1 and p2 have the relation p0<p1<p2.

Process for operation of the third injection system

During the operation of the internal-combustion engine, fuel is available at injection valve 61 with high pressure from common-rail pressure reservoir or with fuel pressure p2 in line 2 and water is continuously available at a lower pressure p1 in line 35.

FIG. 8: In a phase 1, valve 65 is in a position in which control space 15 is joined with common-rail pressure reservoir, and valve member 5 is pressed by pressure onto its piston-shaped end piece 11 into injection opening 4 and valve seat 62, so that no injection occurs from injection valve 61. The inflow of fuel from line 66 with fuel pressure p2 to borehole 9 in front of injection opening 4 through line 2 is interrupted by piston-shaped end piece 11 of valve member 5, whose tapered outer leg 12 is applied onto valve seat 62, and by check valve 38.

Borehole 14 in piston-shaped end piece 11 and borehole 31 in part 6 of housing 3 are aligned and control space 22 is also joined with the common-rail pressure reservoir by means of valve 32, so that piston 20 is applied onto stop 64 of housing 3. Water from line 35 is applied with pressure p1 in front of injection opening 4.

FIG. 9: In a phase 2, valve 65 is in a position, in which control space 15 is joined with the common-rail pressure reservoir, and valve member 5 is pressed into injection opening 4 of injection valve 61 by pressure on piston-shaped end piece 11.

Valve 32 joins control space 22 with line 68 at fuel pressure p0 by means of line 30 and boreholes 14, 31. Water from line 35 is supplied at pressure p1 in front of injection opening 4. Piston 20 is lifted from stop 64 and enlarges the volume in front of injection opening 4 in injection valve 1, so that water can flow from line 35 in front of injection opening 4. The switching time of valve 32 determines the water quantity in injection valve 61. The inflow of fuel to injection opening 4 through line 2 is interrupted by piston-shaped end piece 11 of valve member 5, whose outer leg 12 is applied to valve seat 62.

FIG. 10: In a phase 3, valve 65 is in a position, in which control space 15 is joined with line 66 at fuel pressure p2. Line 2 is pressurized with the common-rail pressure reservoir by means of valve 65 and valve member 5 lifts off under the common-rail pressure on tapered leg 12 of piston-shaped end piece 11 and under pressure from the common-rail pressure reservoir on the front surface of valve member 5 in front of injection opening 4.

Fuel from line 2 with the water available in front of injection opening 4 is injected into the combustion space (not shown) of the internal-combustion engine. The switching time of valve 65 determines the injection quantity.

A choke 67 in line 30 reduces pressure fluctuations in control space 22, so that in phase 3, the piston does not move relative to valve member 5.

Phase 4: Valve 65 and valve 32 return to the initial position in phase 1 (see FIG. 8). Valve member 5 is pressed into injection opening 4 by common-rail pressure applied to piston-shaped end piece 11, so that the injection is terminated by injection valve 61.

Piston 20 is moved to stop 64. The fuel-water mixture from the region in front of injection opening 4 is pressed into line 2 up to check valve 38. Check valve 36 prevents the backflow of the mixture from the region in front of injection opening 4 into line 35.

FIGS. 11–16 each represent cross sections through the fourth injection system 100 of a common-rail system (not shown) whose injection processes essentially comprise 4 phases.

Injection system 100 contains an injection valve 101, which has a housing 103, with a central borehole 107, at least one injection opening 104 and a rotation-symmetric valve member 105. In the direction of the longitudinal axis of housing 103, valve member 105 is supported in a displaceable manner in housing 103 for opening and closing injection opening 104.

Valve member 105 has at its end remote from injection opening 104 a piston-shaped end piece 111, by means of which valve member 105 is guided in borehole 107 of housing 103.

In borehole 107, piston-shaped end piece 111 of valve member 105 forms with housing 103 a control space 115, into which a line 116 opens, which connects control space 115 by means of an electromagnetic 5/2-way valve 125 with a line 139 to the common-rail pressure reservoir or with a line 126 at a pressure p0. From the 5/2-way valve 125, a line 117 leads to line 102, which leads to injection valve 101, and opens into a control space 106, formed between the piston-shaped end piece 111 and housing 103. Line 102 may be joined selectively by means of valve 125 with line 126 at fuel pressure p0 or the common-rail pressure reservoir. A check valve 138 is contained in a branch line 137 from line 126 to the 5/2-way valve 125.

In the vicinity of injection opening 104, a line 108 opens, into which liquid is transported from a tank (not shown) into injection valve 101. A check valve 109 is contained in line 108, which prevents the outflow of fuel mixture from the region in front of injection opening 104 through line 108.

Injection system 100 contains a piston 120 in a positive-displacement housing 118. Piston 120 may be pressure-loaded by an upper control space 119 and by a lower control space 121. Piston 120 is guided in an upper borehole 122 and in a lower borehole 123 of housing 118 by respective shafts 124, 140. Borehole 122 has a ventilation borehole 127. Borehole 123 is joined via connection piece 128 to line 102 to injection valve 101 and via line 117 to valve 125.

A line 130 opens into upper control space 119 and a line 131 opens into lower control space 121. An electromagnetic 4/2-way valve 132 joins lines 130, 131 selectively either with a line 133 at pressure p2 or with a line 134 at a pressure p0.

Process for the operation of the fourth injection system

During the operation of the internal-combustion engine, fuel is available at high pressure at injection valve 101 from the common-rail pressure reservoir or with the fuel pressure p0 in line 102 and liquid is continuously available in line 108.

Figure 11:
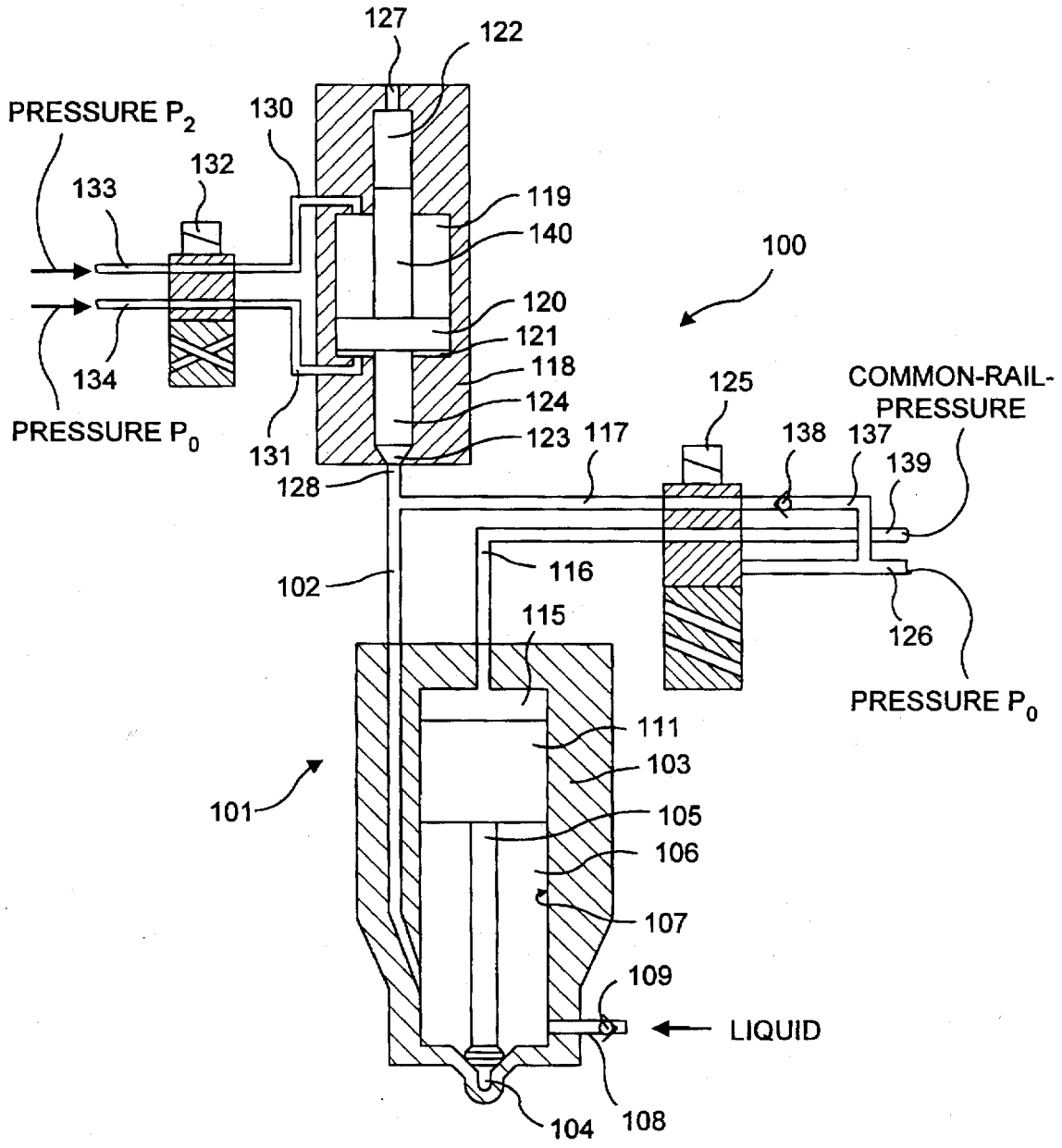
FIG. 11 is a cross section through a fourth injection system in phase 1.

FIG. 11: In a phase 1, valve 125 is in a position, in which control space 115 is pressurized with the common-rail pressure, and valve member 105 is pressed into injection opening 104 by pressure applied to piston-shaped end piece 111, so that no injection occurs from injection valve 101.

Piston 120 is loaded with pressure p2 from upper control space 119 and with pressure p0 from lower control space 121 and is found in a lowered position. Liquid from line 108 is supplied in front of injection opening 104. Fuel from lines 117, 102 at pressure p0 is supplied in front of injection opening 104.

Figure 12:
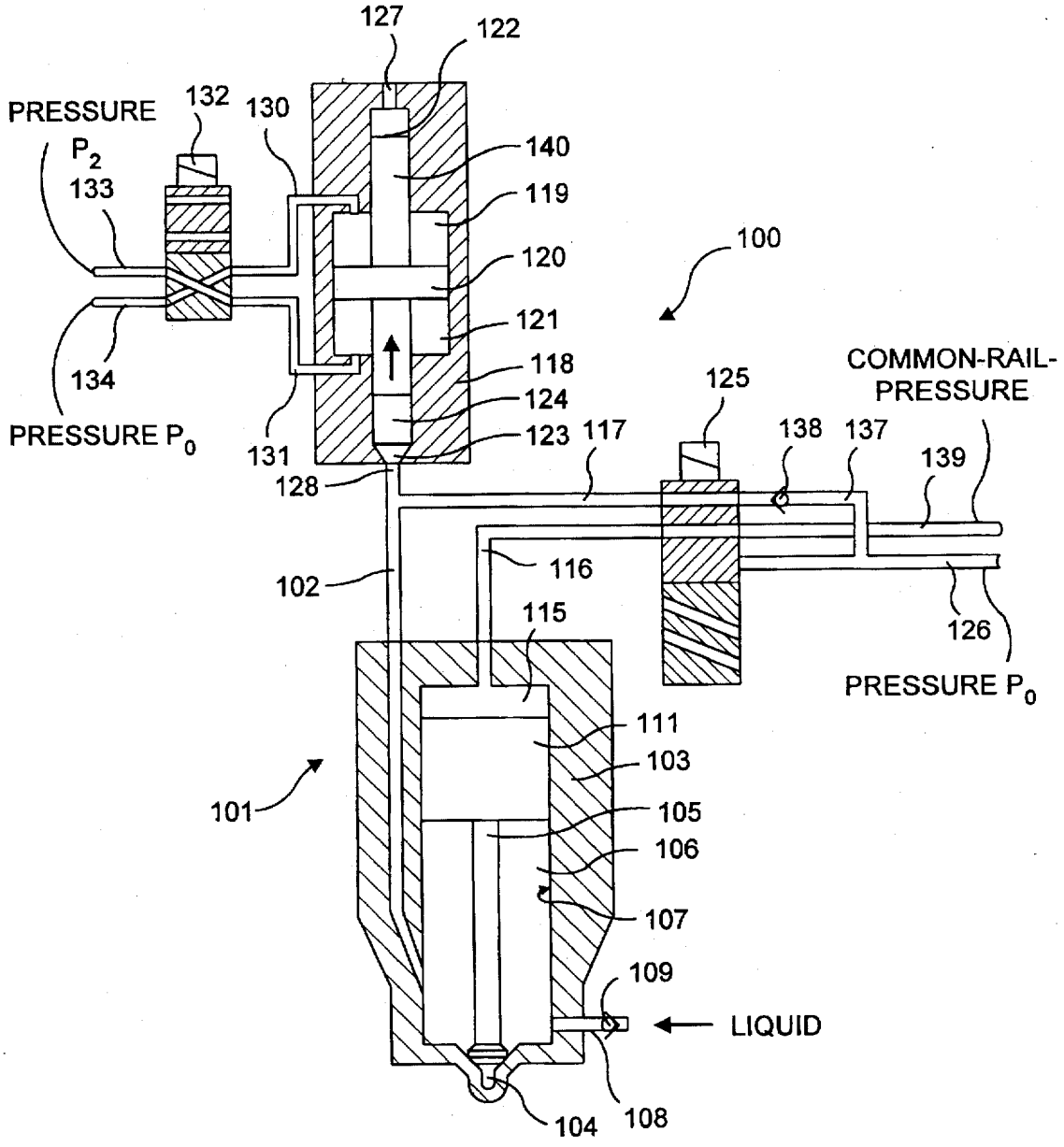
FIG. 12 is a cross section through a fourth injection system in phase 2.

FIG. 12: In a phase 2, valve 125 is in a position, in which control space 115 is connected to the common-rail pressure reservoir, and valve member 105 is pressed into injection opening 104 of injection valve 101 by pressure applied to piston-shaped end piece 111.

Valve 132 is in a position, in which piston 120 is loaded with pressure p0 in upper control space 119 and with pressure p2 in lower control space 121, and thus moves into an upper position. In the movement of piston 120, from bottom to top, the pressure in control space 106 in front of injection opening 104 decreases in injection valve 101 by means of borehole 123, lines 128, 102, so that liquid from line 108 is transported in front of injection opening 104. The connection time of valve 132 determines the liquid quantity introduced into injection valve 101.

Figure 13:
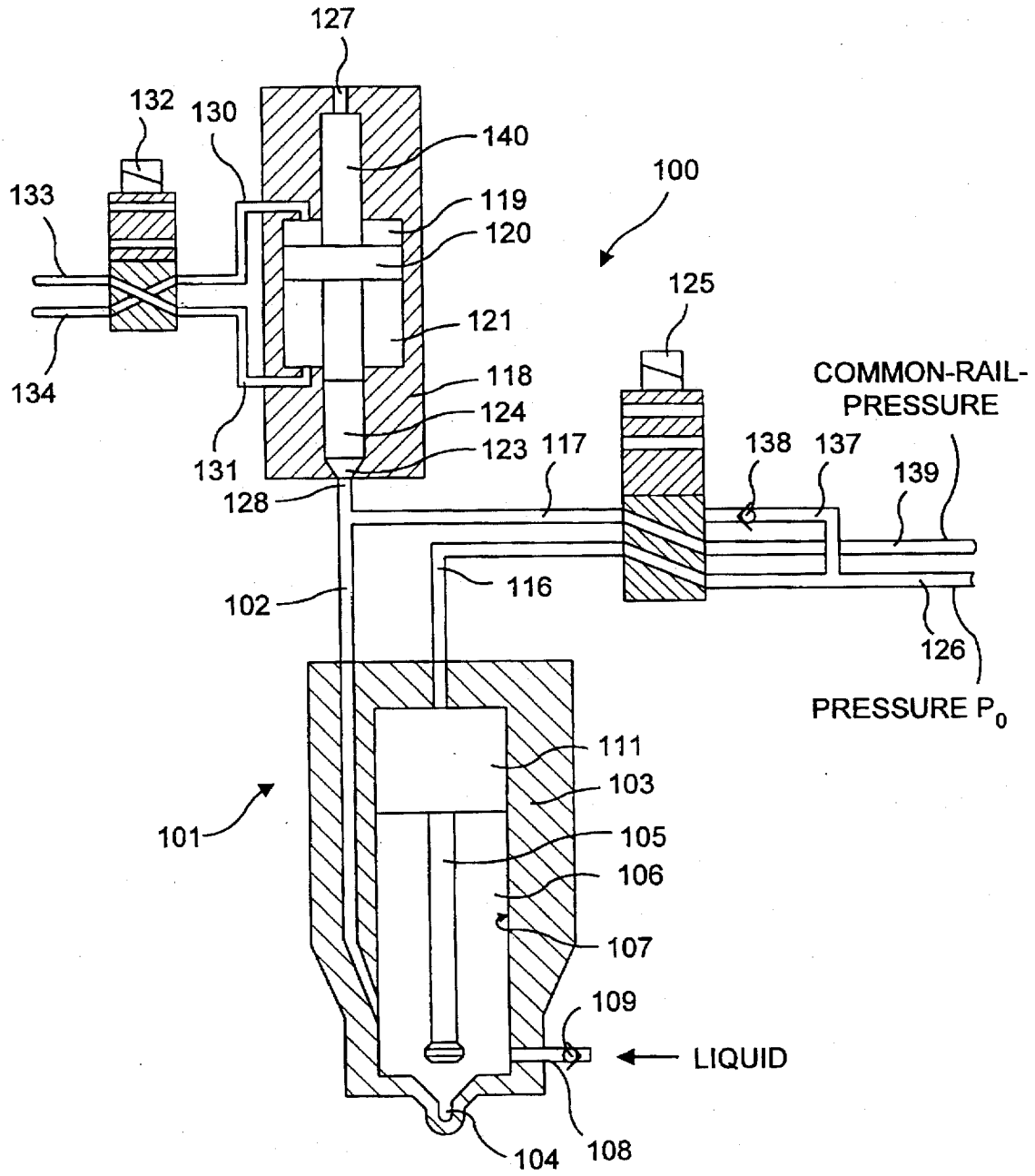
FIG. 13 is a cross section through a fourth injection system in phase 3.

FIG. 13: In a phase 3, valve 125 is in a position in which control space 115 is connected to line 126 at fuel pressure p0. Line 102 is pressurized at the common-rail pressure reservoir by means of valve 125 and valve member 105 lifts under the common-rail pressure applied to piston-shaped end piece 111.

Fuel from line 102 with the liquid available in front of injection opening 104 is injected into the combustion space (not shown) of the internal-combustion engine. The switching time of valve 125 determines the injection quantity.

Phase 4: Valve 125 and valve 132 return to the initial positions in the position of phase 1 (see FIG. 11). Valve member 105 is pressed into injection opening 104 by common-rail pressure applied to its piston-shaped end piece 111, so that the injection through injection valve 101 is terminated.

Piston 120 moves to the lower position. Fuel-liquid mixture from the region in front of injection opening 104 is pressed into lines 117, 126. Check valve 109 prevents the backflow of the mixture from the region in front of injection opening 104 into line 108.

Figure 14:
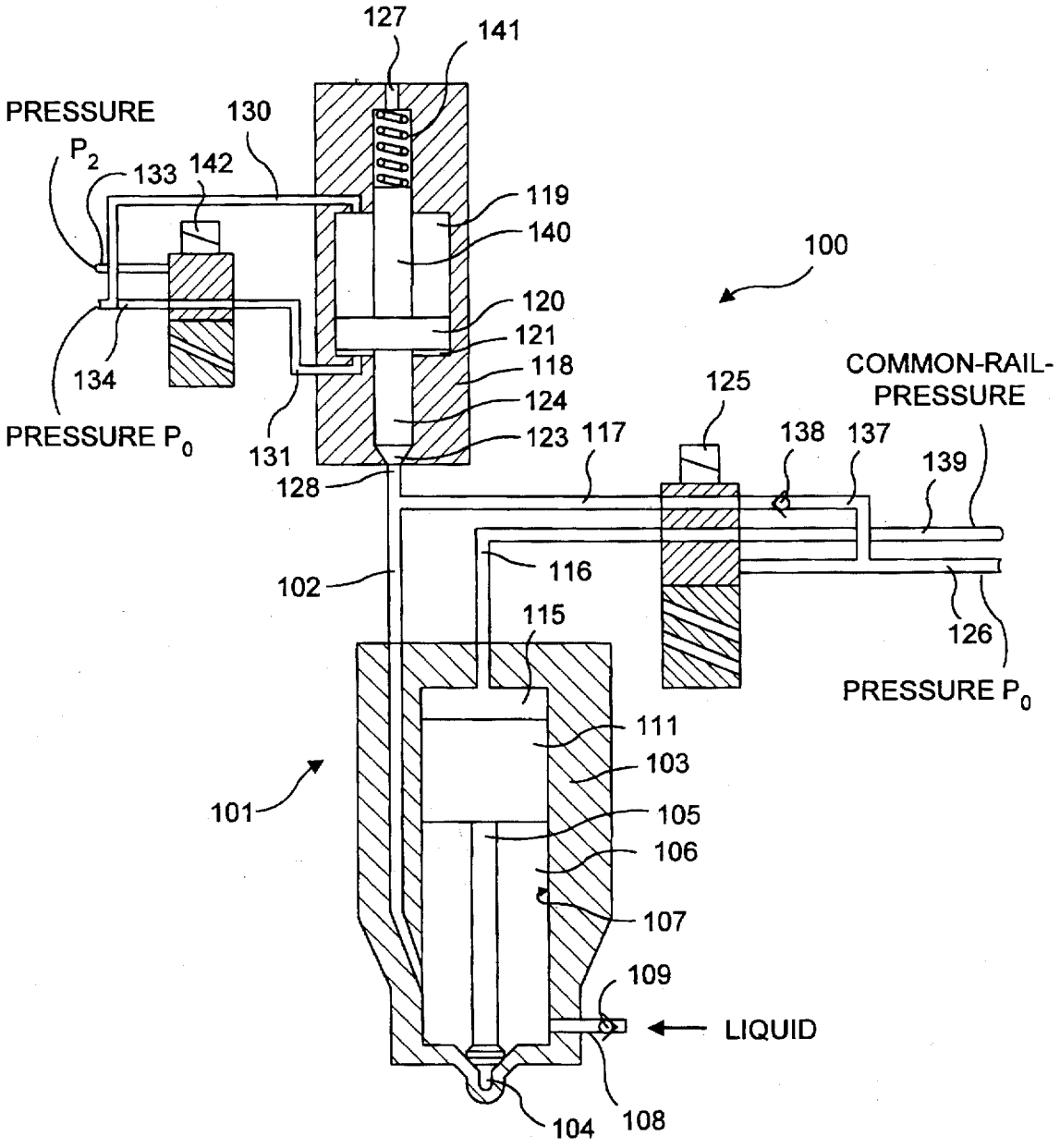
FIG. 14 is a cross section through an advantageous embodiment of this fourth injection system.

FIG. 14 represents a cross section through a modified fourth injection system 100 of a common-rail system (not shown).

The modified, fourth injection system 100 contains piston 120 in positive-displacement housing 118. Piston 120 can be pressurized by lower control space 121. Piston 120 is guided by shaft 140 in upper borehole 122 and by shaft 124 in a lower borehole 123 in housing 118. Borehole 122 has ventilation borehole 127 and includes a pressure spring 141. Borehole 123 is connected via connection piece 128 to line 102 to injection valve 101 and via line 117 to valve 125.

Line 130 opens into the upper control space 119 and line 131 opens into lower control space 121. An electromagnetic 3/2-way valve 142 joins line 131 either with line 133 at pressure p2 or with line 134 at pressure p0. Line 130 is connected to line 134 at pressure p0.

The process for operating the modified fourth injection system corresponds to the process described for FIGS. 11–13 for the operation of the fourth injection system, except for the feature that piston 120 is pressurized not by pressure p2, but by spring 141 into the lower position in housing 118. Valve 142 exclusively connects line 131, selectively with pressure p0 or p2.

Figure 15:
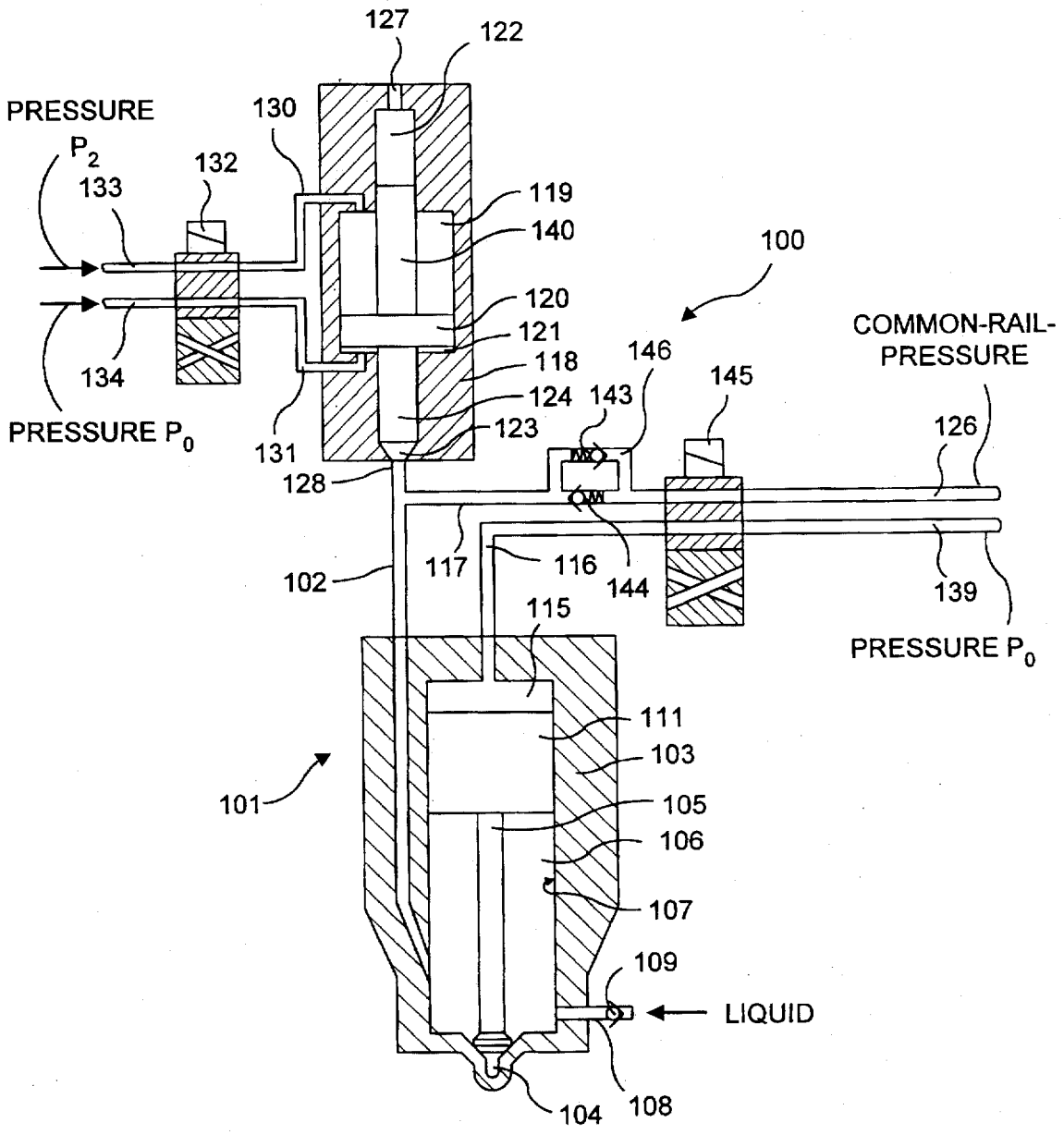
FIG. 15 is a cross section through another advantageous embodiment of this fourth injection.

FIG. 15 shows a cross section through another advantageous configuration of this fourth injection system.

In borehole 107 of injection valve 101, piston-shaped end piece 111 of valve member 105 forms a control space 115 with housing 103, and line 116 opens into space 115, joining control space 115 by means of an electromagnetic 4/2-way valve 145 to line 139 to the-common-rail pressure reservoir or to line 126 at pressure p0. Line 117 leads from the 4/2-way valve 145 to line 102, which leads to injection valve 101, and opens into control space 106, formed by piston-shaped end piece 111 with housing 103. Line 102 may be joined selectively by means of 4/2-way valve 145 with line 126 with fuel pressure p0 or the common-rail pressure reservoir.

A bypass line 146 is connected to line 117. A check valve 144 is contained in line 117 between the connection points of bypass line 146, and this valve blocks the through flow in the direction from 4/2-way valve 145 to the connection of line 117 to line 102. A check valve 143 is contained in bypass line 146, and this valve blocks the through flow in the direction from the connection of line 117 to 4/2-way valve 145.

The process for operating the additional advantageous configuration of this fourth injection system corresponds to the process described for FIGS. 11–13 for the operation of the fourth injection system, except for the feature that the connection from the 4/2-way valve 146 to line 102 is produced by lines 117, 143, 117, and that in phase 4, with the closed injection valve 101, piston 120 moving into its lower position, displaces the fuel mixture through line 117 into line 126 at pressure p0.

Figure 16:
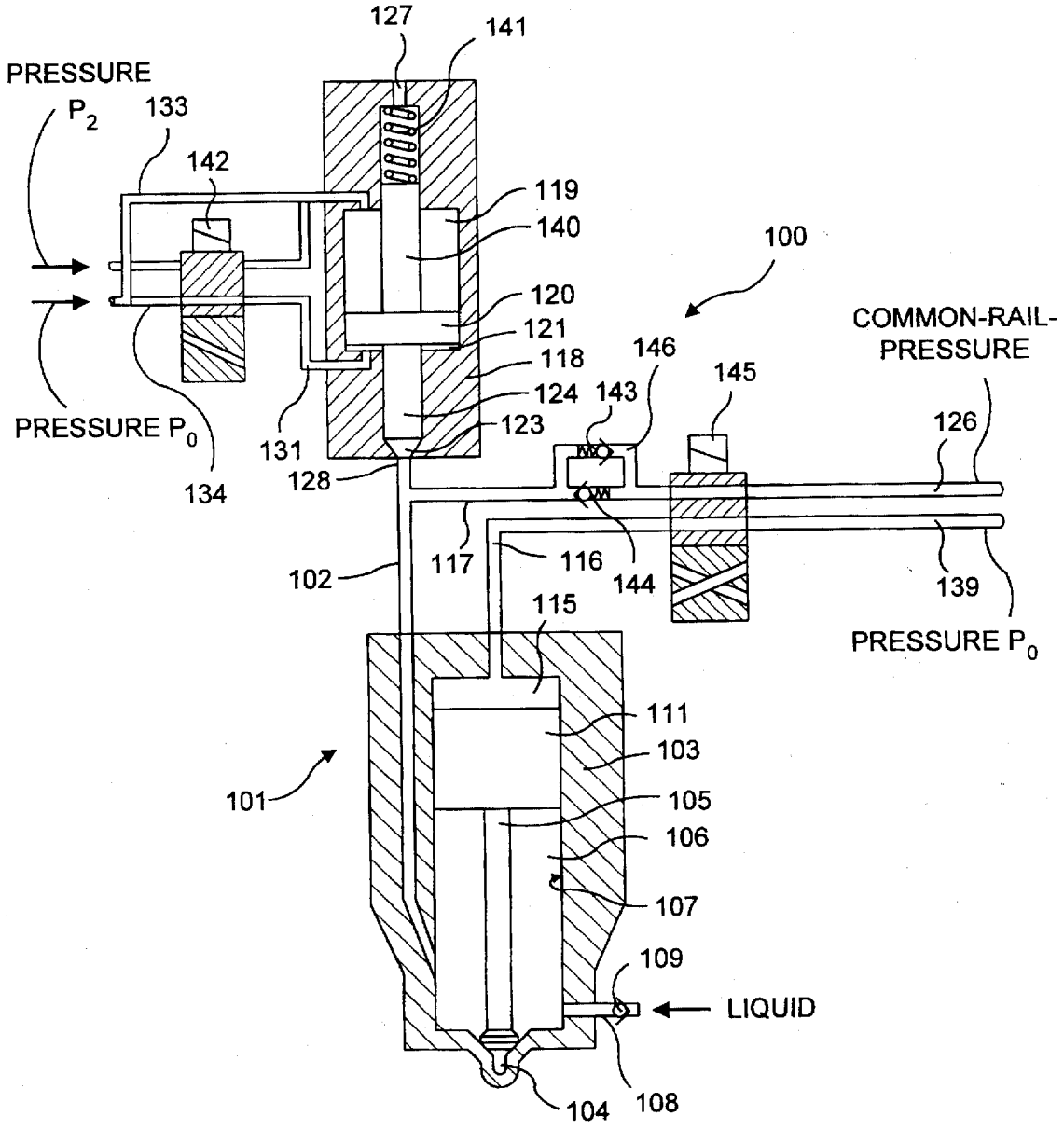
FIG. 16 is a cross section through a combination of the above two of this fourth injection system.

FIG. 16 shows a cross section through a fourth injection system 100, which results from a combination of the additional advantageous configuration of this fourth injection system according to FIG. 15 and the modified fourth injection system according to FIG. 14.

What is claimed is:

1. An injection system for intermittent introduction of a fuel-liquid mixture into a combustion space of an internal combustion engine, said injection system comprising:

a first high pressure line, a first low pressure line, and an injection valve, said injection valve comprising:

a housing having an injection opening for communication with a combustion space of an internal combustion engine, a valve member displaceable in said housing to open and close said injection opening, said valve member and said housing defining a first control space, means for selectively and intermittently connecting said first control space to said first high pressure line or said first low pressure line to pressurize said valve member and enable the valve member to be displaced to close and open said injection opening, means for supply of fuel and liquid into said housing in a region communicating with said injection opening, a second high pressure line, a second low pressure line, a second control space means for selectively and intermittently connecting said second control space to said second high pressure line and said second low pressure line and a piston supported for undergoing relative displacement with respect to said valve member depending on the pressure in said second control space to increase the volume of said region by a determined amount so that liquid is introduced into said region in an amount which is a function of said increase in volume.

2. An injection system as claimed in claim 1, wherein said piston is slidably and coaxially mounted on said valve member in liquid-tight relation.

3. An injection system as claimed in claim 1, wherein said piston is mounted externally of said housing.

4. An injection system as claimed in claim 1, wherein said means for supply of fuel and liquid into said housing comprises a common line supplying fuel and liquid into said region in said housing.

5. An injection system as claimed in claim 1, wherein said means for supply of fuel and liquid into said housing comprises a fuel line opening into said region in said housing adjacent to said valve opening and a separate liquid line in communication with said region.

6. An injection system as claimed in claim 4, wherein said piston is operatively positioned relative to said fuel line to control flow of fuel to said region.

7. An injection system as claimed in claim 1, wherein said means connected to said first high and low pressure lines and said means connected to said second high and low pressure lines respectively comprise first and second electromagnetic control valve means.

8. An injection system as claimed in claim 7, wherein said means for supply of fuel and liquid into said housing comprises a fuel line opening into said region in said housing adjacent to said valve opening and a separate liquid line in communication with said region, one of said first and second high pressure lines supplying fuel to said fuel line via a respective one of said first and second electromagnetic control valve means.

9. An injection system for intermittent introduction of a fuel-liquid mixture into a combustion space of an internal combustion engine, said injection system comprising:

a first high pressure line, a first low pressure line, and an injection valve, said injection valve comprising:

a housing having an injection opening for communication with a combustion space of an internal combustion engine, a valve member displaceable in said housing to open and close said injection opening, said valve member and said housing defining a first control space, means for selectively and intermittently connecting said first control space to said first high pressure line or said first low pressure line to pressurize said valve member and enable the valve member to be displaced to close and open said injection opening, a fuel line connected to a high pressure fuel supply, said fuel line opening into a region of said housing adjacent to said injection opening, a piston displaceably arranged in coaxially movable manner on said valve member, said valve member and said piston defining a second control space, means for selectively and intermittently connecting said second control space to a second high pressure line or a second low pressure line, and a liquid line for supplying liquid to said region for mixing liquid with fuel for discharge from said injection opening, said valve member closing said injection opening when said first control space is connected to said first high pressure line, said piston being movable when said second control space is connected to said second low pressure line to form a volume communicating with said region into which is introduced an amount of liquid as a function of said volume so that when said valve member opens said injection opening fuel will be discharge therefrom with said amount of liquid.

10. An injection system as claimed in claim 9, wherein said means for selectively and intermittently connecting said second control space to the second high pressure line or the second low pressure line comprises an electro—magnetic 3/2 way valve.

11. An injection as claimed in claim 9, wherein said fuel line includes a check valve to block passage of fuel to said region while permitting reverse flow of liquid and fuel mixture from said region into the fuel line, and means upstream of said check valve to supply fuel to said region, said piston being positioned to control flow of fuel to said region, said liquid line including a check valve therein permitting passage of liquid to said region but blocking backflow therefrom, said piston and said housing providing both a stop to limit displacement of said piston and a valve controlling flow of fuel from the fuel line to said region.

12. An injection system as claimed in claim 9, wherein said housing has a central borehole provided with a plurality of steps at which said borehole has a change in diameter, said piston having an outer periphery which has steps conforming to said steps of said borehole, said housing being provided with overflow boreholes opening into said central borehole.

13. An injection system as claimed in claim 9, wherein said first low pressure line is at a pressure p2, said second low pressure line is at a pressure p0, said line for supply of fuel and liquid mixture is at a pressure p1, wherein $p0<p1<p2$.

14. An injection system as claimed in claim 13, wherein said first high pressure line is connected to a high pressure fuel supply, said means for selectively and intermittently connecting said first control space to said first high pressure line or said first low pressure line comprising an electromagnetic valve, said fuel line being connected to said electromagnetic valve for being selectively and intermittently connected to said first high pressure line or said first low pressure line.

15. An injection system as claimed in claim 14, wherein said fuel line includes a check valve to block fuel passage to said region while permitting reverse flow of liquid and fuel mixture from said region into the fuel line, and means upstream of said check valve to supply fuel to said region, said piston being positioned to control flow of fuel to said region, said liquid line including a check valve therein permitting passage of liquid to said region but blocking backflow therefrom, said piston and said housing providing both a stop to limit displacement of said piston and a valve controlling flow of fuel to said region.

16. An injection system as claimed in claim 13, comprising a choke in a line connecting said second control space to said means which selectively and intermittently connects said second control space to said second high or low pressure lines.

17. An injection system as claimed in claim 13, wherein said electromagnetic valve is operative to connect the fuel line with the first low pressure line while connecting the first control space to the first high pressure line or to connect the fuel line to the first high pressure line and the first control space to the first low pressure line.

18. An injection system for intermittent introduction of a fuel-liquid mixture into a combustion space of an internal combustion engine, said injection system comprising:

A first high pressure line, a first low pressure line, and an injection valve, said injection valve comprising:

a housing having an injection opening for communication with a combustion space of an internal combustion engine, a valve member displaceable in said housing to open and close said injection opening, said valve member and said housing defining a first control space, means for selectively and intermittently connecting said first control space to said first high pressure line or said first low pressure line to pressurize said valve member and enable the valve member to be displaced to close and open said injection opening, a piston displaceably arranged in coaxially movable manner on said valve member, said valve member and said piston defining a second control space, means for selectively and intermittently connecting said second control space to a second high pressure line or a second low pressure line, and a line for continuously supplying fuel and liquid mixture to a region of said housing communicating with said injection opening, said valve member closing said injection opening said amount of liquid and fuel mixture will be discharged when said first control space is connected to said first high pressure line, said piston being movable when said second control space is connected to said second low pressure line to form a volume communicating with said region into which is introduced an amount of liquid and fuel mixture as a function of said volume so that when said valve member opens said injection opening fuel will be discharged therefrom with said amount of liquid and fuel mixture.

19. An injection system as claimed in claim 18, wherein said valve member has two boreholes spaced in the direction of movement of said valve member, said housing being provided with two boreholes connected respectively to said second high and low pressure lines, said two boreholes in said valve member respectively communicating with said two boreholes in said housing when said valve member opens and closes said valve opening.

20. An injection system as claimed in claim 19, comprising spring means between said valve member and said housing.

21. An injection system for intermittent introduction of a fuel-liquid mixture into a combustion space of an internal combustion engine, said injection system comprising:

a first high pressure line, a first low pressure line, and an injection valve, said injection valve comprising:

a first housing having an injection opening for communication with a combustion space of an internal combustion engine, a valve member displaceable in said housing to open and close said injection opening, said valve member and said housing defining a first control space, means for selectively and intermittently connecting said first control space to said first high pressure line or said first low pressure line to pressurize said valve member and enable said valve member to be displaced to close and open said injection opening, a fuel line opening into said first housing adjacent to said injection opening, a second housing, a piston displaceable in said second housing, said piston defining upper and lower control spaces on opposite sides of the piston, a second high pressure line, a second low pressure line, means for selectively connecting said lower control space selectively with said second high and low pressure lines, said second housing having a bore in which a shaft of said piston is slidable, said fuel line being connected to said bore, a liquid line connected to said first housing to supply liquid therein adjacent to said injection opening, and means for producing an incremental volume in said first housing when said injection opening is closed and said fuel line is disconnected from a fuel source so that said liquid is supplied to said first housing in an amount equal to said incremental volume whereby when the injection opening is opened said amount of liquid will be supplied with fuel therefrom.

22. An injection system as claimed in claim 21, wherein said means which selectively connects said lower control space with said second high and low pressure lines is connected to said upper control space to selectively and respectively connect said upper control space with said second high and low pressure lines.

23. An injection system as claimed in claim 21, wherein said upper control space is connected to said second high pressure line, said system further comprising a spring in said second housing urging said piston in a direction to reduce said lower control space.

24. An injection system as claimed in claim 21, comprising a bypass line connected to said first low pressure line, a further line connected to said fuel line, said means which selectively and intermittently connects said first control space to said first high and low pressure lines comprising a 4/2 way valve for selectively connecting said first control space and said further line to said first high and low pressure lines and said bypass line and a check valve in said bypass line upstream of said 4/2 way valve to prevent backflow in said bypass line.

25. An injection system as claimed in claim 21, wherein said upper control space is connected to said second high pressure line, said system further comprising a spring in said second housing urging said piston in a direction to reduce said lower control space, a further line connected to said fuel line, said means which selectively and intermittently connects said first control space to said first high and low pressure lines comprising a 4/2 way valve for selectively connecting said first control space and said further line to said first high and low pressure lines, a bypass loop connected in said further line, and a check valve in said bypass loop preventing backflow of fuel thereon.

26. A process for intermittent introduction of a fuel-liquid mixture into a combustion space of an internal combustion engine, said process comprising:

providing an injection valve having a housing provided with an injection opening from which fuel and liquid can be supplied to a combustion space of an internal combustion engine, intermittently opening and closing said injection opening by a displaceable valve member in said housing, forming a region in said housing communicating with said injection opening, introducing the fuel and liquid into said region for discharge from said injection valve when said valve member opens said injection opening, displacing said valve member in said housing by selectively and intermittently connecting a first control space formed between said valve member and said housing to a first high pressure line or a first low pressure line to cause said valve member to intermittently open and close said injection opening, and selectively and intermittently connecting a piston to a second high pressure line and a second low pressure line to produce relative movement of said piston with respect to said valve member when said valve member closes said injection opening so that the volume of said region is increased, and introducing into said region an amount of said liquid related to the increase of volume of said region produced when said piston undergoes relative movement with respect to said valve member.

27. A process as claimed in claim 26, comprising providing a second control space between said valve member and said piston, connecting said first control space to said first high pressure line and connecting said second control space to said first low pressure line in a first phase of operation during which injection does not occur, connecting said first control space to said first low pressure line and connecting said second control space to said first high pressure line in a second phase of operation in which injection occurs, connecting said first control space to said first high pressure line and connecting said second control space to said first low pressure line in a subsequent phase during which injection does not occur, and the volume of said region in said housing is increased.

28. A process as claimed in claim 26, comprising providing a second control space between said valve member and said piston, connecting said first control space to said first high pressure line and connecting said second control space to said second high pressure line in a first phase of operation during which injection does not occur, connecting said first control space to said first high pressure line and connecting said second control space to said second low pressure line in a second phase of operation during which injection does not occur, and said piston is displaced to increase the volume of said region and said liquid is introduced into said region of said housing in an mount corresponding to the increased volume, continuing said connecting of said first control space to said first high pressure line and said connecting said second control space to said second low pressure line in a third phase of operation, during which injection does not occur and said piston reaches a final displaced position to complete the introduction of said liquid into said region, connecting said first control space to said first low pressure line and connecting said second control space to said second low pressure line in a fourth phase of operation, during which said piston opens inflow of fuel from said fuel line to said region and said valve member opens said injection opening and injection occurs, and connecting said first control space to said first high pressure line in a fifth phase of operation, during which said injection opening is closed and no injection occurs, and fuel in said region is transported back into said fuel line.

29. A process as claimed in claim 26, comprising providing a second control space between said valve member and said piston, connecting said first control space to said first high pressure line and connecting said second control space to said second high pressure line in a first phase of operation, during which injection does not occur, and a fuel line opening into said region is connected to said second low pressure line which is at a fuel pressure p2, connecting said first control space to said first high pressure line and connecting said second control space to said second low pressure line which is at a pressure p0 in a second phase of operation, during which injection does not occur and said fuel line is connected to said second low pressure line and said piston is moved upward, and liquid in a liquid line is introduced into said region at a pressure p1, connecting said first control space to said first low pressure line and connecting said second control space to said second high pressure line in a third phase of operation during which said fuel line is pressurized by said first high pressure line and injection occurs, and said valve member is applied against said housing, and connecting said first control space to said first high pressure line in a fourth phase, in which said fuel line is connected to said first low pressure line during which no injection occurs and fuel is conducted back from said region into said fuel line by said piston.

30. A process as claimed in claim 26, said piston forming upper and lower control spaces in a second housing, said process further comprising:

connecting said first control space to the first high pressure line and connecting said lower control space to said second lower pressure line at a pressure p0 in a first phase of operation during which injection does not occur and a fuel line communicating with said region is connected to said first low pressure line at a pressure p0, connecting said lower control space to said second low pressure line at pressure p2 and connecting said first control space to said first high pressure line in a second phase of operation, during which injection does not occur and said piston moves upwardly and liquid from a liquid line connected to said region is supplied into said region, connecting said first control space to said first low pressure line at pressure p0 and connecting said lower control space to said second low pressure line at pressure p2 in a third phase of operation while said fuel line is at the pressure in the first high pressure line and injection is carried out, and connecting said first control space to the first high pressure line in a fourth phase of operation, in which said fuel line is connected to said first low pressure line at pressure p0, during which no injection occurs, and the liquid and fuel mixture undergoes backflow into the fuel supply line as said piston moves downwardly to a lower position.

* * * * *